US010115515B2

(12) United States Patent
Ishikawa et al.

(10) Patent No.: US 10,115,515 B2
(45) Date of Patent: Oct. 30, 2018

(54) MULTILAYER COMMON MODE FILTER

(71) Applicant: TDK CORPORATION, Tokyo (JP)

(72) Inventors: Yuma Ishikawa, Tokyo (JP); Takuo Hattori, Tokyo (JP); Makoto Yoshino, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 15/263,824

(22) Filed: Sep. 13, 2016

(65) Prior Publication Data

US 2017/0092414 A1 Mar. 30, 2017

(30) Foreign Application Priority Data

Sep. 30, 2015 (JP) ..... 2015-193801

(51) Int. Cl.

| | |
|---|---|
| ***H01F 5/00*** | (2006.01) |
| ***H01F 27/28*** | (2006.01) |
| ***H01F 27/245*** | (2006.01) |
| ***H01F 27/29*** | (2006.01) |
| ***H01F 17/00*** | (2006.01) |

(52) U.S. Cl.

CPC ..... *H01F 27/2804* (2013.01); *H01F 17/0013* (2013.01); *H01F 27/245* (2013.01); *H01F 27/292* (2013.01); *H01F 2017/0066* (2013.01); *H01F 2027/2809* (2013.01)

(58) Field of Classification Search

None

See application file for complete search history.

(56) References Cited

U.S. PATENT DOCUMENTS

2015/0035621 A1* 2/2015 Ahn ..... H02M 1/126 333/184
2016/0372254 A1* 12/2016 Harada ..... H01F 27/2804
2017/0092413 A1* 3/2017 Matsunaga ..... H01F 27/245

FOREIGN PATENT DOCUMENTS

JP 2009-064785 A 3/2009
JP 2012-109326 A 6/2012

* cited by examiner

*Primary Examiner* — Ronald Hinson
(74) *Attorney, Agent, or Firm* — Oliff PLC

(57) ABSTRACT

A second coil opposes a first coil in a first direction. The first and second coils are positioned between a first conductor and a second conductor in the first direction. The first conductor is adjacent to the first coil in the first direction and overlaps a part of the first coil when viewed from the first direction. The second conductor is adjacent to the second coil in the first direction and overlaps a part of the second coil when viewed from the first direction. The first and second conductors are of a shape extending in a line. Inner regions of the first and second coils include regions not overlapping the first and second conductors when viewed from the first direction.

6 Claims, 14 Drawing Sheets

MULTILAYER COMMON MODE FILTER

TECHNICAL FIELD

The present invention relates to a multilayer common mode filter.

BACKGROUND

A multilayer common mode filter disclosed in Japanese Unexamined Patent Publication No. 2012-109326 includes an element body that has a non-magnetic portion including a non-magnetic material and a pair of magnetic portions including magnetic materials and oppose each other with the non-magnetic portion therebetween, first and second coils that are disposed in the non-magnetic portion and oppose each other in a first direction in which the pair of magnetic portions oppose each other, and first and second conductors that are disposed in the element body and are connected to a ground. The first and second coils are positioned between the first conductor and the second conductor in the first direction. In the multilayer common mode filter, a floating capacity is generated between the first coil and the second conductor and between the second coil and the second conductor. For this reason, an attenuation peak (attenuation pole) in a frequency characteristic of an attenuation amount for common mode noise is shifted to a high frequency side and a depth thereof is large.

SUMMARY

In the multilayer common mode filter disclosed in Japanese Unexamined Patent Publication No. 2012-109326, because the first and second conductors have a solid shape or an annular shape when viewed from the first direction, the following problems may occur.

The first and second conductors have the solid shape, and inner regions of the first and second coils are covered with the first and second conductors when viewed from the first direction. In this case, because magnetic flux generated by the first and second coils is inhibited by the first and second conductors, in the multilayer common mode filter, inductance decreases and common mode impedance decreases.

In the case in which the first and second conductors have the annular shape, if the magnetic flux generated by the first and second coils passes through the first and second conductors, counter-electromotive force is generated in the first and second conductors. For this reason, magnetic flux to offset the magnetic flux generated by the first and second coils is generated in the first and second conductors. Therefore, even in this case, in the multilayer common mode filter, the inductance decreases and the common mode impedance decreases.

If the common mode impedance decreases, a frequency band in which a desired attenuation characteristic is obtained is narrowed.

An object of one aspect of the present invention is to provide a multilayer common mode filter in which an attenuation peak in a frequency characteristic of an attenuation amount for common mode noise is shifted to a high frequency side, a depth of the attenuation peak is large, and common mode impedance is suppressed from decreasing.

A multilayer common mode filter according to one aspect of the present invention includes an element body that has a non-magnetic portion including a non-magnetic material and a pair of magnetic portions including a magnetic material and opposing each other with the non-magnetic portion therebetween; a first terminal electrode, a second terminal electrode, a third terminal electrode, a fourth terminal electrode, a first terminal ground electrode, and a second terminal ground electrode that are disposed in the element body; a first coil that is disposed in the non-magnetic portion and is electrically connected to the first terminal electrode and the third terminal electrode; a second coil that is disposed in the non-magnetic portion and is electrically connected to the second to urinal electrode and the fourth terminal electrode, and first and second conductors that are disposed in the non-magnetic portion and are electrically connected to the first terminal ground electrode and the second terminal ground electrode. The second coil opposes the first coil in a first direction in which the pair of magnetic portions oppose each other. The first and second conductors are of a shape extending in a line. The first and second coils are positioned between the first conductor and the second conductor in the first direction. The first conductor is adjacent to the first coil in the first direction and overlaps a part of the first coil when viewed from the first direction. The second conductor is adjacent to the second coil in the first direction and overlaps a part of the second coil when viewed from the first direction. Inner regions of the first and second coils include regions not overlapping the first and second conductors when viewed from the first direction.

In the multilayer common mode filter according to the one aspect, the first conductor adjacent to the first coil in the first direction overlaps the part of the first coil when viewed from the first direction. For this reason, a floating capacity is generated between the first conductor and the first coil. The second conductor adjacent to the second coil in the first direction overlaps the part of the second coil when viewed from the first direction. For this reason, a floating capacity is generated between the second conductor and the second coil. Therefore, in the multilayer common mode filter according to the one aspect, an attenuation peak (attenuation pole) in a frequency characteristic of an attenuation amount for common mode noise is shifted to a high frequency side and a depth thereof is large.

The first and second conductors are of the shape extending in the line. Therefore, even when magnetic flux generated by the first and second coils passes through the first and second conductors, counter-electromotive force is hard to be generated in the first and second conductors. The inner regions of the first and second coils include the regions not overlapping the first and second conductors when viewed from the opposing direction. For this reason, the magnetic flux generated by the first and second coils is hard to be inhibited by the first and second conductors. As a result, in the multilayer common mode filter according to the one aspect, common mode impedance is suppressed from decreasing.

In the multilayer common mode filter according to the one aspect, the first and second conductors may are of a shape extending in a straight line. In the multilayer common mode filter of this embodiment, parasitic inductance of the first and second conductors is small as compared with a multilayer common mode filter in which the first and second conductors are of a shape (for example, a meanderingly extending shape or a crank shape) other than the shape extending in the straight line. As a result, the depth of the attenuation peak is larger.

In the multilayer common mode filter according to the one aspect, widths of the first and second conductors may be smaller than widths of the inner regions of the first and second coils. In the multilayer common mode filter of this embodiment, even in the case in which the first and second conductors overlap the inner regions of the first and second coils when viewed from the first direction, the inner regions of the first and second coils surely include the regions not overlapping the first and second conductors when viewed from the first direction.

In the multilayer common mode filter according to one aspect, each of the first and second conductors may include a first conductor portion connected to the first terminal ground electrode, a second conductor portion connected to the second terminal ground electrode, and a third conductor portion connecting the first conductor portion and the second conductor portion. In this case, a width of the third conductor portion may be larger than widths of the first and second conductor portions. A boundary between the first conductor portion and the third conductor portion and a boundary between the second conductor portion and the third conductor portion may overlap the first and second coils when viewed from the first direction.

Because an entire end of the first conductor portion exposed to a surface of the non-magnetic portion needs to be covered with the first terminal ground electrode, the width of the first conductor portion needs to be set smaller than the width of the first terminal ground electrode. Because an entire end of the second conductor portion exposed to the surface of the non-magnetic portion needs to be covered with the second terminal ground electrode, the width of the second conductor portion needs to be set smaller than the width of the second terminal ground electrode.

If the width of the first conductor increases, residual inductance in the floating capacity generated between the first conductor and the first coil decreases. If the width of the second conductor increases, residual inductance in the floating capacity generated between the second conductor and the second coil decreases. If the residual inductance decreases, the depth of the attenuation peak increases. In the case in which the boundary between the first conductor portion and the third conductor portion and the boundary between the second conductor portion and the third conductor portion overlap the first and second coils when viewed from the first direction, the third conductor portion surely overlaps the first and second coils when viewed from the first direction.

From the above configurations, in the case in which the width of the third conductor portion is larger than the widths of the first and second conductor portions, that is, the widths of the first and second conductor portions are smaller than the width of the third conductor portion, connectivity of the first conductor portion and the first terminal ground electrode and connectivity of the second conductor portion and the second terminal ground electrode are secured and the depth of the attenuation peak is large.

In the case in which the boundary between the first conductor portion and the third conductor portion and the boundary between the second conductor portion and the third conductor portion overlap the first and second coils when viewed from the first direction, even when a position deviation occurs in the first coil and the first conductor, the floating capacity generated between the first conductor and the first coil is hard to be varied. Likewise, even when a position deviation occurs in the second coil and the second conductor, the floating capacity generated between the second conductor and the second coil is hard to be varied. Therefore, a characteristic of the multilayer common mode filter is suppressed from being varied.

The first coil may include first and second coil conductors of a spiral shape electrically connected to each other and the second coil may include third and fourth coil conductors of a spiral shape electrically connected to each other. In this case, the first coil conductor and the third coil conductor may be adjacent to each other in the first direction, and the second coil conductor and the fourth coil conductor may be adjacent to each other in the first direction. The third coil conductor may be positioned between the first coil conductor and the second coil conductor in the first direction. In the multilayer common mode filter of this embodiment, magnetic coupling of the first coil and the second coil is strong.

The multilayer common mode filter according to the one aspect may further include first and second discharge electrodes that are disposed in the element body and are separated from each other. In this case, any one of the first and second discharge electrodes may be electrically connected to the first terminal ground electrode and the second terminal ground electrode. The multilayer common mode filter of this embodiment has an electro-static discharge (ESD) absorption function of absorbing ESD.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION

Figure 1:
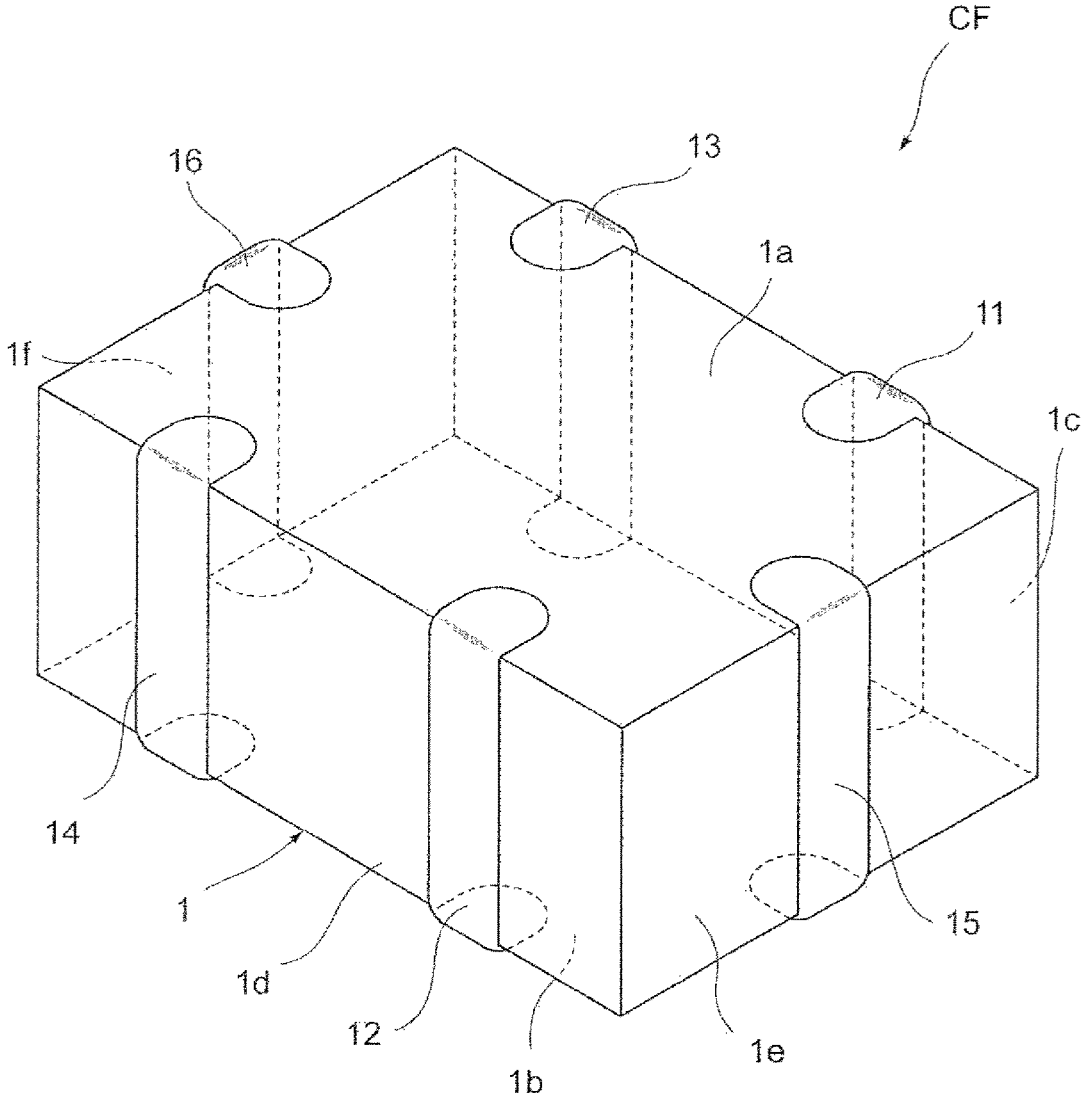
FIG. 1 is a perspective view illustrating a multilayer common mode filter according to an embodiment.

Hereinafter, an embodiment of the present invention will be described in detail with reference to the accompanying drawings. In the following description, the same element or an element having the same function is denoted with the same reference numeral and overlapped description is omitted.

Figure 2:
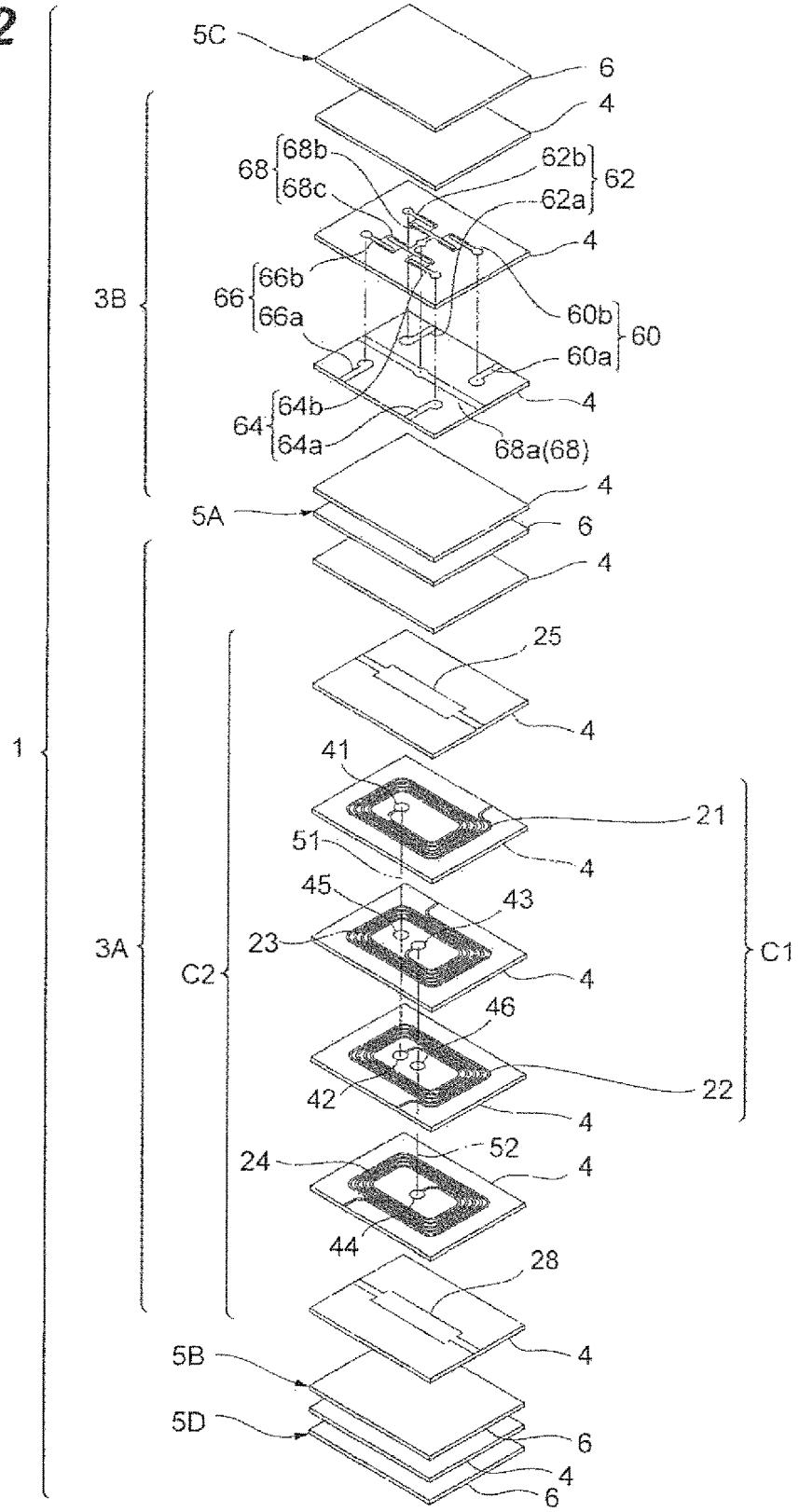
FIG. 2 is an exploded perspective view illustrating a configuration of an element body.
Figure 3:
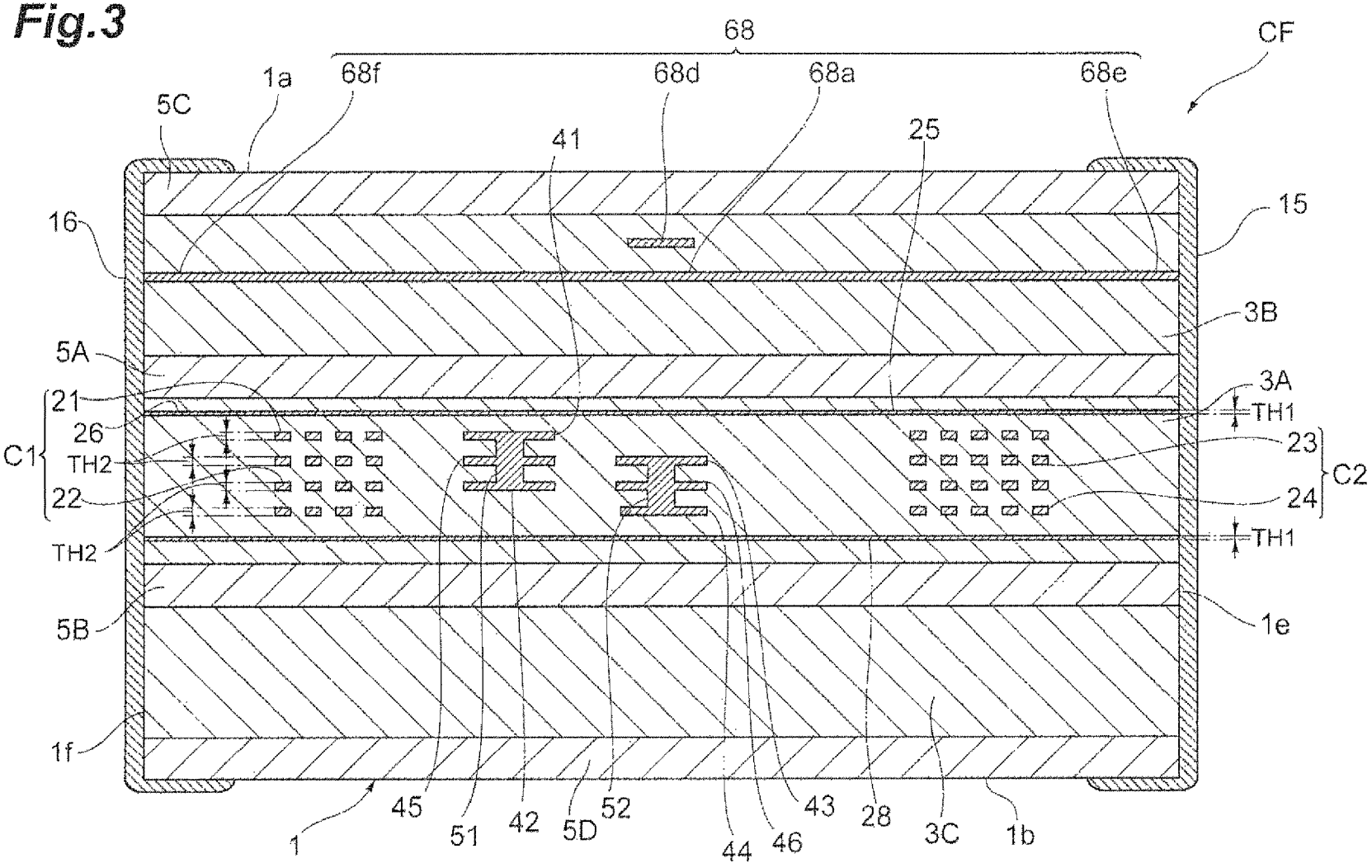
FIG. 3 is a diagram illustrating a sectional configuration of the element body including a first terminal ground electrode and a second terminal ground electrode.
Figure 4:
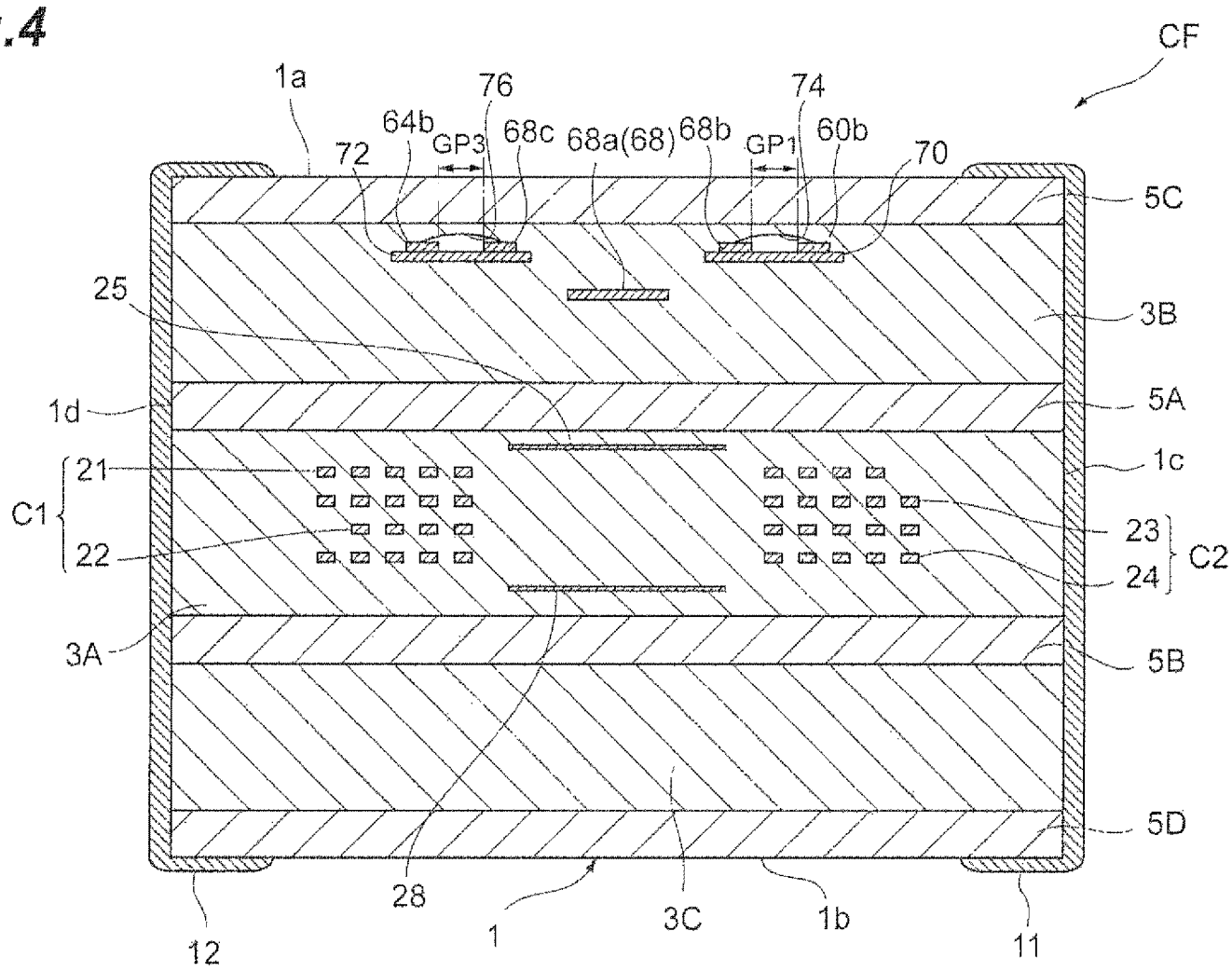
FIG. 4 is a diagram illustrating a sectional configuration of the element body including a first gap portion and a third gap portion.
Figure 5:
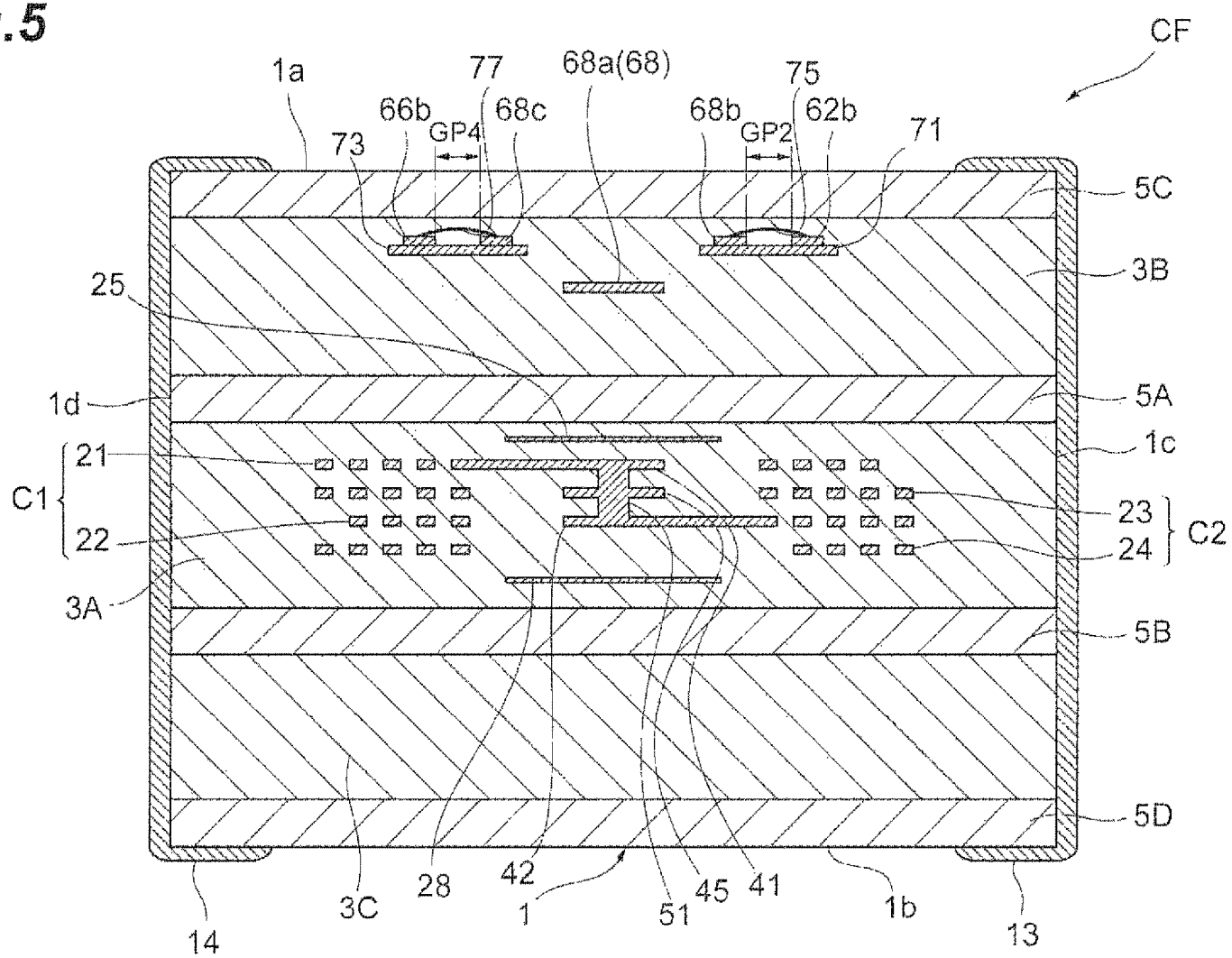
FIG. 5 is a diagram illustrating a sectional configuration of the element body including a second gap portion and a fourth gap portion.

A configuration of a multilayer common mode filter CF according to an embodiment will be described with reference to FIGS. 1 to 5. FIG. 1 is a perspective view illustrating a multilayer common mode filter according to this embodiment. FIG. 2 is an exploded perspective view illustrating a configuration of an element body. FIG. 3 is a diagram illustrating a sectional configuration of the element body including a first terminal ground electrode and a second terminal ground electrode. FIG. 4 is a diagram illustrating a sectional configuration of the element body including first and third gap portions. FIG. 5 is a diagram illustrating a sectional configuration of the element body including second and fourth gap portions.

As illustrated in FIGS. 1 to 5, the multilayer common mode filter CF includes an element body 1, a first terminal electrode 11, a second terminal electrode 12, a third terminal electrode 13, a fourth terminal electrode 14, a first terminal ground electrode 15, and a second terminal ground electrode 16. The first terminal electrode 11, the second terminal electrode 12, the third terminal electrode 13, the fourth terminal electrode 14, the first terminal ground electrode 15, and the second terminal ground electrode 16 are disposed on an external surface of the element body 1. The multilayer common mode filter CF is mounted on an electronic apparatus (for example, a circuit board or an electronic component). Each of the first terminal electrode 11, the second terminal electrode 12, the third terminal electrode 13, and the fourth terminal electrode 14 is connected to a signal line. The first terminal ground electrode 15 and the second terminal ground electrode 16 are connected to ground.

The element body 1 has a rectangular parallelepiped shape. The element body 1 has a first principal surface 1*a* and a second principal surface 1*b* having a rectangular shape and opposing each other, a first side surface 1*c* and a second side surface 1*d* opposing each other, and a third side surface 1*e* and a fourth side surface 1*f* opposing each other, as external surfaces thereof. A longitudinal direction of the element body 1 is a direction in which the third side surface 1*e* and the fourth side surface 1*f* oppose each other. A width direction of the element body 1 is a direction in which the first side surface 1*c* and the second side surface 1*d* oppose each other. A height direction of the element body 1 is a direction in which the first principal surface 1*a* and the second principal surface 1*b* oppose each other. The rectangular parallelepiped shape includes a shape of a rectangular parallelepiped in which a corner portion and a ridge portion are chamfered and a shape of a rectangular parallelepiped in which a corner portion and a ridge portion are rounded.

The first side surface 1*c* and the second side surface 1*d* extend in the height direction of the element body 1 to connect the first principal surface 1*a* and the second principal surface 1*b*. The first side surface 1*c* and the second side surface 1*d* also extend in the height direction (long-side direction of the first principal surface 1*a* and the second principal surface 1*b*) of the element body 1. The third side surface 1*e* and the fourth side surface 1*f* extend in the height direction of the element body 1 to connect the first principal surface 1*a* and the second principal surface 1*b*. The third side surface 1*e* and the fourth side surface 1*f* also extend in the width direction (short-side direction of the first principal surface 1*a* and the second principal surface 1*b*) of the element body 1.

The element body 1 has three non-magnetic portions 3A, 3B, and 3C and four magnetic portions 5A, 5B, 5C, and 5D disposed to sandwich the individual non-magnetic portions 3A, 3B, and 3C in the height direction of the element body 1. The three non-magnetic portions 3A, 3B, and 3C and the four magnetic portions 5A, 5B, 5C, and 5D are disposed in order of the magnetic portion 5C, the non-magnetic portion 3B, the magnetic portion 5A, the non-magnetic portion 3A, the magnetic portion 5B, the non-magnetic portion 3C, and the magnetic portion 5D in the height direction of the element body 1. The pair of magnetic portions 5A and 5B oppose each other with the non-magnetic portion 3A therebetween. The pair of magnetic portions 5A and 5C oppose each other with the non-magnetic portion 3B therebetween. The pair of magnetic portions 5B and 5D oppose each other with the non-magnetic portion 3C therebetween. The element body 1 is configured by a plurality of laminated insulator layers.

In the individual non-magnetic portions 3A, 3B, and 3C, a plurality of non-magnetic layers 4 are laminated as insulator layers. The individual non-magnetic portions 3A, 3B, and 3C are configured by the plurality of laminated non-magnetic layers 4. In the individual magnetic portions 5A, 5B, 5C, and 5D, a plurality of magnetic layers 6 are laminated as insulator layers. The individual magnetic portions 5A, 5B, 5C, and 5D are configured by the plurality of laminated magnetic layers 6. The plurality of insulator layers include the plurality of non-magnetic layers 4 and the plurality of magnetic layers 6. In FIG. 2, illustration of some non-magnetic layers 4 of the plurality of non-magnetic layers 4 and illustration of some magnetic layers 6 of the plurality of magnetic layers 6 are omitted to clarify a structure.

Each non-magnetic layer 4 is configured by a sintered body of a ceramic green sheet including a non-magnetic material (a Cu—Zn based ferrite material, a dielectric material, or a glass ceramic material), for example. Each magnetic layer 6 is configured by a sintered body of a ceramic green sheet including a magnetic material (a Ni—Cu—Zn based ferrite material, a Ni—Cu—Zn—Mg based ferrite material, or a Ni—Cu based ferrite material), for example.

In the actual element body 1, the individual non-magnetic layers 4 and the individual magnetic layers 6 are integrated in such a manner that inter-layer boundaries cannot be visualized. The height direction of the element body 1, that is, a direction in which the first principal surface 1*a* and the second principal surface 1*b* oppose each other coincides with a direction in which the plurality of insulator layers, that is, the plurality of non-magnetic layers 4 and the plurality of magnetic layers 6 are laminated (hereinafter, simply referred to as the "lamination direction"). A direction in which the pair of magnetic portions 5A and 5B oppose each other also coincides with the lamination direction.

The first terminal electrode 11 and the third terminal electrode 13 are disposed on the first side surface 1*e* of the element body 1. The first terminal electrode 11 and the third terminal electrode 13 are formed in such a manner that a part of the first side surface 1*c* is covered along the height direction of the element body 1, and are formed on a part of the first principal surface 1*a* and a part of the second principal surface 1*b*. The first terminal electrode 11 is positioned at the side of the third side surface 1*e* and the third terminal electrode 13 is positioned at the side of the fourth side surface 1*f*.

The second terminal electrode 12 and the fourth terminal electrode 14 are disposed on the second side surface 1*d* of the element body 1. The second terminal electrode 12 and the fourth terminal electrode 14 are formed in such a manner that a part of the second side surface 1*d* is covered along the height direction of the element body 1, and are formed on a part of the first principal surface 1*a* and a part of the second principal surface 1*b*. The second terminal electrode 12 is positioned at the side of the third side surface 1*e* and the fourth terminal electrode 14 is positioned at the side of the fourth side surface 1*f*.

The first terminal ground electrode 15 is disposed on the third side surface 1*e* of the element body 1. The first terminal ground electrode 15 is formed in such a manner that a part of the third side surface 1*e* is covered along the height direction of the element body 1, and is formed on a part of the first principal surface 1*a* and a part of the second principal surface 1*b*. The second terminal ground electrode 16 is disposed on the fourth side surface 1*f* of the element body 1. The second terminal ground electrode 16 is formed in such a manner that a part of the fourth side surface 1*f* is covered along the height direction of the element body 1, and is formed on a part of the first principal surface 1*a* and a part of the second principal surface 1*b*.

Each of the terminal electrodes 11 to 16 includes a conductive material (for example, Ag or Pd). Each of the terminal electrodes 11 to 16 is configured as a sintered body of conductive paste including a conductive material (for example, Ag powder or Pd powder). A plating layer is formed on a surface of each of the terminal electrodes 11 to 16. The plating layer is formed by electroplating, for example. The plating layer has a layer structure including a Cu plating layer, a Ni plating layer, and a Sn plating layer or a layer structure including a Ni plating layer and a Sn plating layer.

The multilayer common mode filter CF includes a first coil conductor 21, a second coil conductor 22, a third coil conductor 23, a fourth coil conductor 24, a first connection conductor 31, a second connection conductor 32, a third connection conductor 33, a fourth connection conductor 34, a first conductor 25, and a second conductor 28 in the non-magnetic portion 3A, as illustrated in FIGS. 2 to 5. Each of the conductors 21 to 24, 31 to 34, 25, and 28 includes a conductive material (for example, Ag or Pd). Each of the conductors 21 to 24, 31 to 34, 25, and 28 is configured as a sintered body of conductive paste including a conductive material (for example, Ag powder or Pd powder).

Figure 6A:
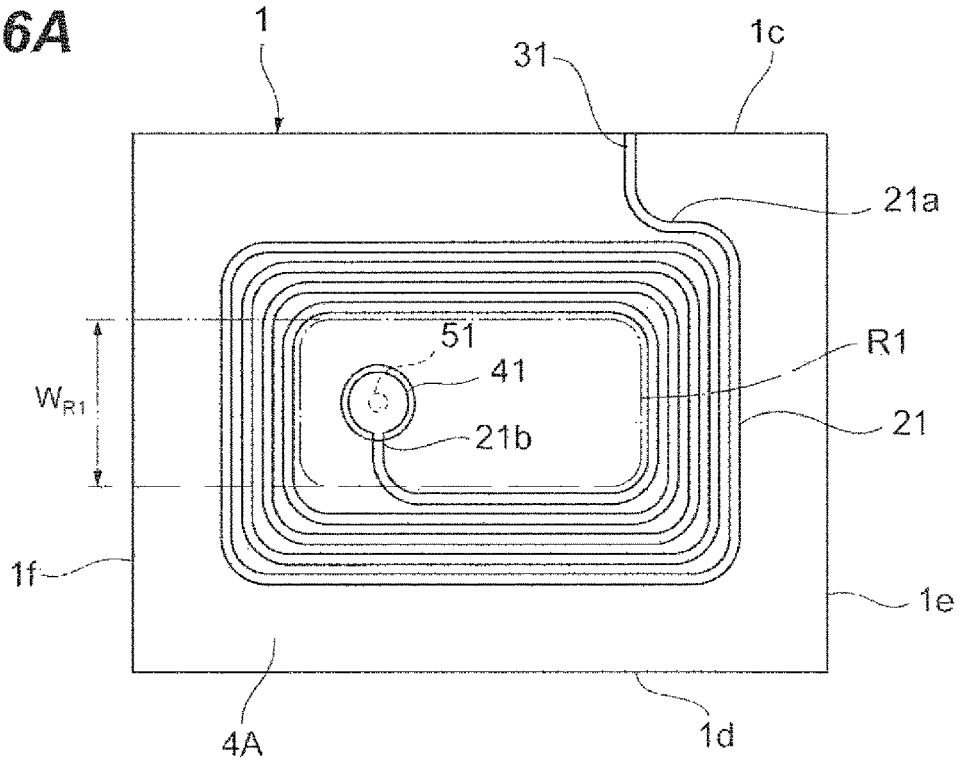
FIG. 6A is a plan view illustrating a first coil conductor.

The first coil conductor 21 has a spiral shape as illustrated in FIG. 6A, and is disposed between the pair of non-magnetic layers 4 adjacent to each other in the lamination direction. One end (outer end) 21*a* of the first coil conductor 21 is connected to the first connection conductor 31 positioned at the same layer as the first coil conductor 21. An end of the first connection conductor 31 is exposed to the first side surface 1*c*. The first connection conductor 31 is connected to the first terminal electrode 11 at the end exposed to the first side surface 1*c*. The other end (inner end) 21*b* of the first coil conductor 21 is connected to a pad conductor 41 positioned at the same layer as the first coil conductor 21. In this embodiment, the first coil conductor 21, the first connection conductor 31, and the pad conductor 41 are integrally formed.

Figure 6B:
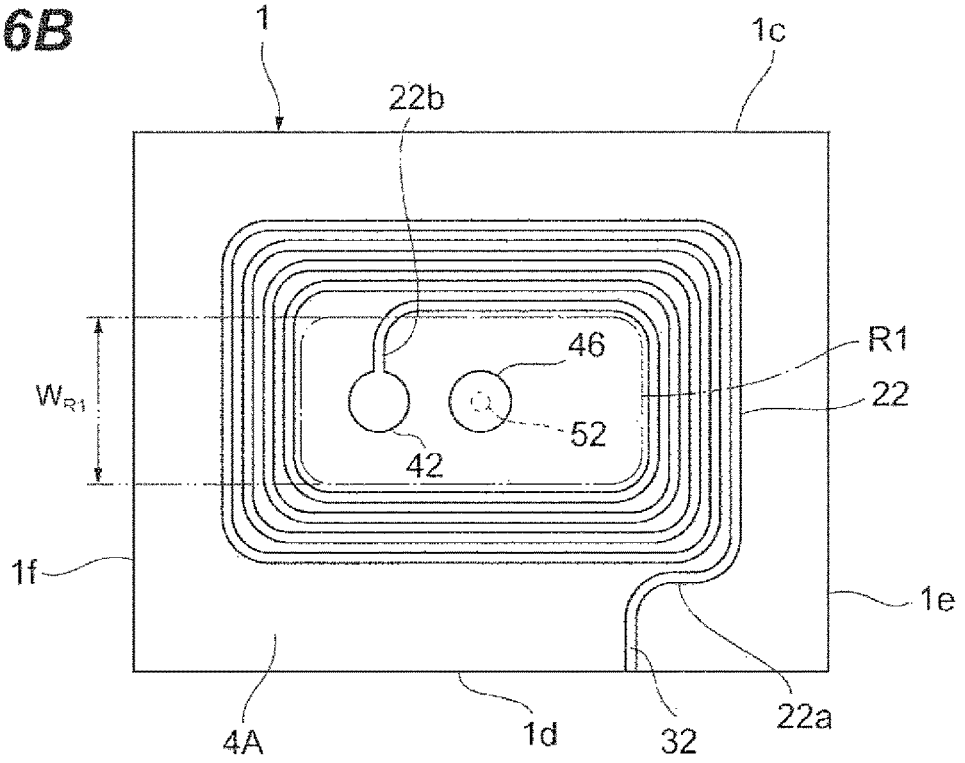
FIG. 6B is a plan view illustrating a second coil conductor.

The second coil conductor 22 has a spiral shape as illustrated in FIG. 6B, and is disposed between the pair of non-magnetic layers 4 adjacent to each other in the lamination direction. One end (outer end) 22*a* of the second coil conductor 22 is connected to the second connection conductor 32 positioned at the same layer as the second coil conductor 22. An end of the second connection conductor 32 is exposed to the second side surface 1*d*. The second connection conductor 32 is connected to the second terminal electrode 12 at the end exposed to the second side surface 1*d*. The other end (inner end) 22*b* of the second coil conductor 22 is connected to a pad conductor 42 positioned at the same layer as the second coil conductor 22. In this embodiment, the second coil conductor 22, the second connection conductor 32, and the pad conductor 42 are integrally formed.

Figure 7A:
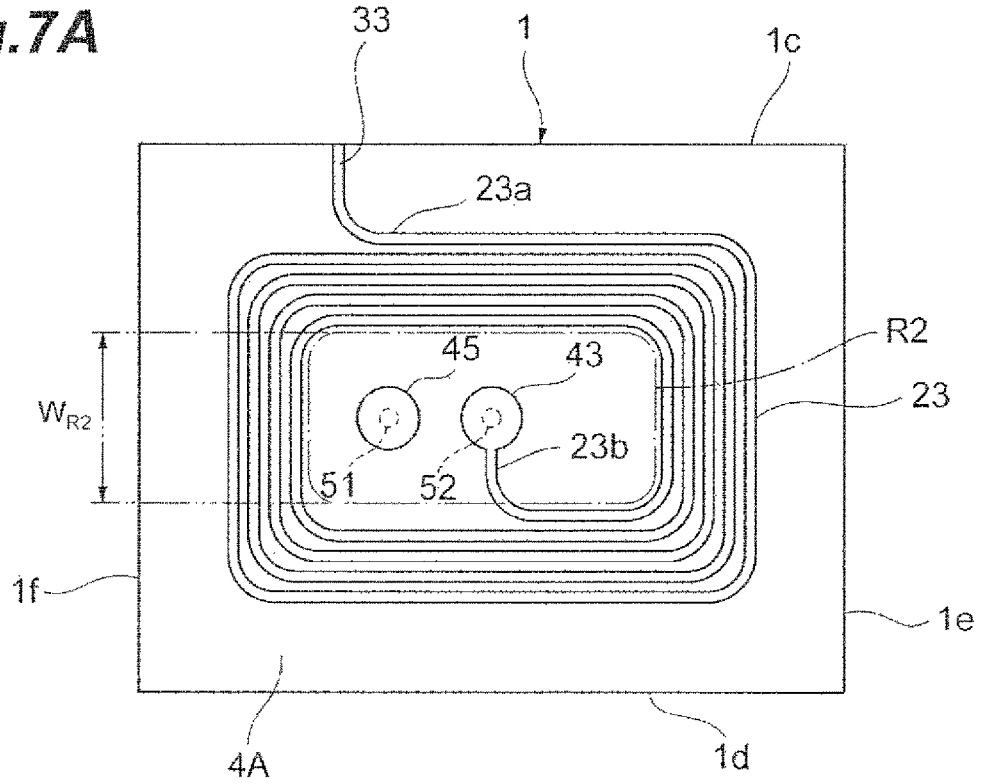
FIG. 7A is a plan view illustrating a third coil conductor.

The third coil conductor 23 has a spiral shape as illustrated in FIG. 7A and is disposed between the pair of non-magnetic layers 4 adjacent to each other in the lamination direction. One end (outer end) 23*a* of the third coil conductor 23 is connected to the third connection conductor 33 positioned at the same layer as the third coil conductor 23. An end of the third connection conductor 33 is exposed to the first side surface 1*c*. The third connection conductor 33 is connected to the third terminal electrode 13 at the end exposed to the first side surface 1*c*. The other end (inner end) 23*b* of the third coil conductor 23 is connected to a pad conductor 43 positioned at the same layer as the third coil conductor 23. In this embodiment, the third coil conductor 23, the third connection conductor 33, and the pad conductor 43 are integrally formed.

Figure 7B:
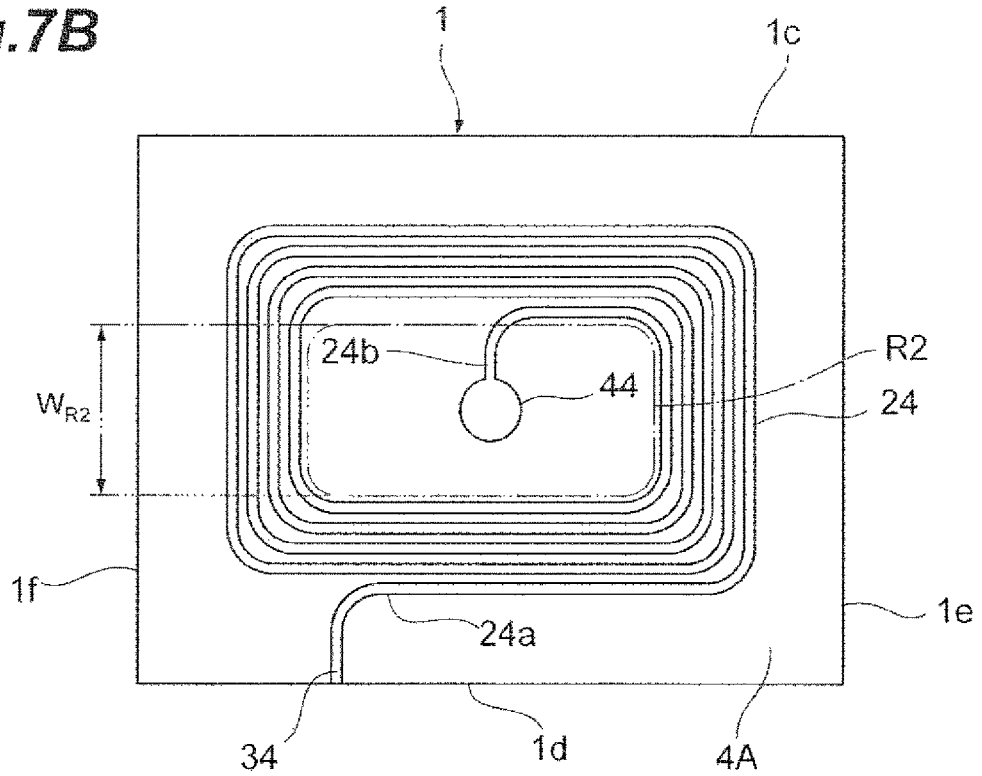
FIG. 7B is a plan view illustrating a fourth coil conductor.

The fourth coil conductor 24 has a spiral shape as illustrated in FIG. 7B and is disposed between the pair of non-magnetic layers 4 adjacent to each other in the lamination direction. One end (outer end) 24*a* of the fourth coil conductor 24 is connected to the fourth connection conductor 34 positioned at the same layer as the fourth coil conductor 24. An end of the fourth connection conductor 34 is exposed to the second side surface 1*d*. The fourth connection conductor 34 is connected to the fourth terminal electrode 14 at the end exposed to the second side surface 1*d*. The other end (inner end) 24*b* of the fourth coil conductor 24 is connected to a pad conductor 44 positioned at the same layer as the fourth coil conductor 24. In this embodiment, the fourth coil conductor 24, the fourth connection conductor 34, and the pad conductor 44 are integrally formed.

The first coil conductor 21 and the third coil conductor 23 are adjacent to each other in the lamination direction with the non-magnetic layer 4 therebetween. The second coil conductor 22 and the fourth coil conductor 24 are adjacent to each other in the lamination direction with the non-magnetic layer 4 therebetween. The third coil conductor 23 is positioned between the first coil conductor 21 and the second coil conductor 22 in the lamination direction. That is, the first, second, third, and fourth coil conductors 21, 22, 23, and 24 are disposed in order of the first coil conductor 21, the third coil conductor 23, the second coil conductor 22, and the fourth coil conductor 24 in the lamination direction. The first, second, third and fourth coil conductors 21, 22, 23, and 24 are wound in the same direction and overlap each other, when viewed from the lamination direction.

The pad conductor 41 and the pad conductor 42 overlap each other when viewed from the lamination direction. A pad conductor 45 positioned at the same layer as the third coil conductor 23 is disposed between the pad conductor 41 and the pad conductor 42. The pad conductor 45 overlaps the pad conductors 41 and 42 when viewed from the lamination direction. The pad conductor 41 and the pad conductor 45 are adjacent to each other in the lamination direction with the non-magnetic layer 4 therebetween. The pad conductor 45 and the pad conductor 42 are adjacent to each other in the lamination direction with the non-magnetic layer 4 therebetween.

The pad conductors 41, 45, and 42 are connected via a through-hole conductor 51. The through-hole conductor 51 penetrates the non-magnetic layer 4 positioned between the pad conductor 41 and the pad conductor 45 and the non-magnetic layer 4 positioned between the pad conductor 45 and the pad conductor 42.

The pad conductor 43 and the pad conductor 44 overlap each other when viewed from the lamination direction. A pad conductor 46 positioned at the same layer as the second coil conductor 22 is disposed between the pad conductor 43 and the pad conductor 44. The pad conductor 46 overlaps the pad conductors 43 and 44 when viewed from the lamination direction. The pad conductor 43 and the pad conductor 46 are adjacent to each other in the lamination direction with the non-magnetic layer 4 therebetween. The pad conductor 46 and the pad conductor 44 are adjacent to each other in the lamination direction with the non-magnetic layer 4 therebetween.

The pad conductors 43, 46, and 44 are connected via a through-hole conductor 52. The through-hole conductor 52 penetrates the non-magnetic layer 4 positioned between the pad conductor 43 and the pad conductor 46 and the non-magnetic layer 4 positioned between the pad conductor 46 and the pad conductor 44.

The first coil conductor 21 and the second coil conductor 22 are electrically connected via the pad conductor 41, the pad conductor 45, the pad conductor 42, and the through-hole conductor 51. The first coil conductor 21 and the second coil conductor 22 configure a first coil C1. The third coil conductor 23 and the fourth coil conductor 24 are electrically connected via the pad conductor 43, the pad conductor 46, the pad conductor 44, and the through-hole conductor 52. The third coil conductor 23 and the fourth coil conductor 24 configure a second coil C2. The multilayer common mode filter CF includes the first coil C1 and the second coil C2 in the element body 1. The first coil C1 and the second coil C2 are disposed in the non-magnetic portion 3A, in such a manner that the first coil conductor 21 and the third coil conductor 23 are adjacent to each other in the lamination direction, the second coil conductor 22 and the fourth coil conductor 24 are adjacent to each other in the lamination direction, and the third coil conductor 23 is positioned between the first coil conductor 21 and the second coil conductor 22 in the lamination direction.

Each of the pad conductors 41, 42, 43, 44, 45, and 46 and the through-hole conductors 51 and 52 includes a conductive material (for example, Ag or Pd). Each of the pad conductors 41, 42, 43, 44, 45, and 46 and the through-hole conductors 51 and 52 is configured as a sintered body of conductive paste including a conductive material (for example, Ag powder or Pd powder). The through-hole conductors 51 and 52 are formed by sintering conductive paste filled into through-holes formed in ceramic green sheets to form the corresponding non-magnetic layers 4.

The first conductor 25 and the second conductor 28 are disposed in the non-magnetic portion 3A. The first coil C1 and the second coil C2 are positioned between the first conductor 25 and the second conductor 28 in the lamination direction. The first conductor 25 is adjacent to the first coil C1 (first coil conductor 21) in the lamination direction. The first conductor 25 is positioned between the first coil C1 (first coil conductor 21) and the magnetic portion 5A in the lamination direction. The second conductor 28 is adjacent to the second coil C2 (fourth coil conductor 24) in the lamination direction. The second conductor 28 is positioned between the second coil C2 (fourth coil conductor 24) and the magnetic portion 5B in the lamination direction.

Figure 8:
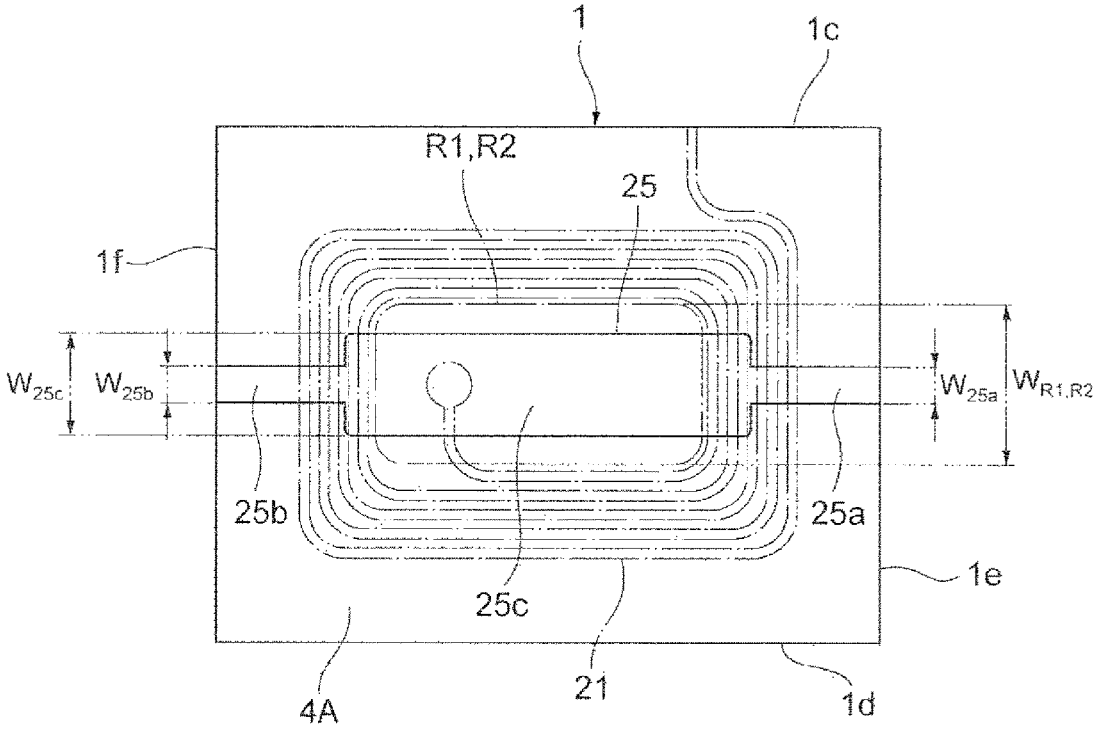
FIG. 8 is a plan view illustrating a first conductor.

The first conductor 25 includes a first conductor portion 25*a*, a second conductor portion 25*b*, and a third conductor portion 25*c*, as illustrated in FIG. 8. The first conductor 25 is of a shape extending in a line. In this embodiment, the first conductor 25 is of a shape extending in a straight line. The first conductor portion 25*a*, the second conductor portion 25*b*, and the third conductor portion 25*c* are integrally formed.

The first conductor portion 25*a* includes one end that is exposed to the third side surface 1*e*. The one end of the first conductor portion 25*a* is connected to the first terminal ground electrode 15. The second conductor portion 25*b* includes one end that is exposed to the fourth side surface 1*f*. The one end of the second conductor portion 25*b* is connected to the second terminal ground electrode 16. The third conductor portion 25*c* connects the first conductor portion 25*a* and the second conductor portion 25*b*. The third conductor portion 25*c* includes one end that is connected to the other end of the first conductor portion 25*a* and the other end that is connected to the other end of the second conductor portion 25*b*.

The first conductor 25 is connected to the first terminal ground electrode 15 and the second terminal ground electrode 16. The first terminal ground electrode 15 and the second terminal ground electrode 16 are electrically connected via the first conductor portion 25*a*, the third conductor portion 25*c*, and the second conductor portion 25*b*.

A width $W_{25c}$ of the third conductor portion 25*c* is larger than a width $W_{25a}$ of the first conductor portion 25*a* and a width $W_{25b}$ of the second conductor portion 25*b*. In this embodiment, the width $W_{25a}$ and the width $W_{25b}$, are equivalent to each other.

In the present specification, the width is a length in the direction (width direction of the element body 1) in which the first side surface 1*c* and the second side surface 1*d* oppose each other. In the present specification, "equivalent" does not necessarily mean only that values are exactly equal to each other. Even in a case in which a slight difference within a predetermined range or a manufacturing error is included in the values, the values may be regarded as being equivalent to each other. For example, in a case in which a plurality of values is included within a range of ±5% from an average value of the plurality of values, the plurality of values is defined to be equivalent to each other.

The first conductor 25 overlaps a part of the first coil C1, that is, a part of the first coil conductor 21, when viewed from the lamination direction. In this embodiment, each of a region of the other end side of the first conductor portion 25*a*, a region of the other end side of the second conductor portion 25*b*, a region of one end side of the third conductor portion 25*c*, and a region of the other end side of the third conductor portion 25*c* overlaps the first coil conductor 21, when viewed from the lamination direction.

A boundary between the first conductor portion 25*a* and the third conductor portion 25*c* and a boundary between the second conductor portion 25*b* and the third conductor portion 25*c* overlap the first coil C1, when viewed from the lamination direction. Specifically, the boundary between the first conductor portion 25*a* and the third conductor portion 25*c* and the boundary between the second conductor portion 25*b* and the third conductor portion 25*c* are positioned in an annular region in which an entire conductor portion of a spiral shape in the first coil conductor 21 is positioned, when viewed from the lamination direction.

Figure 9:
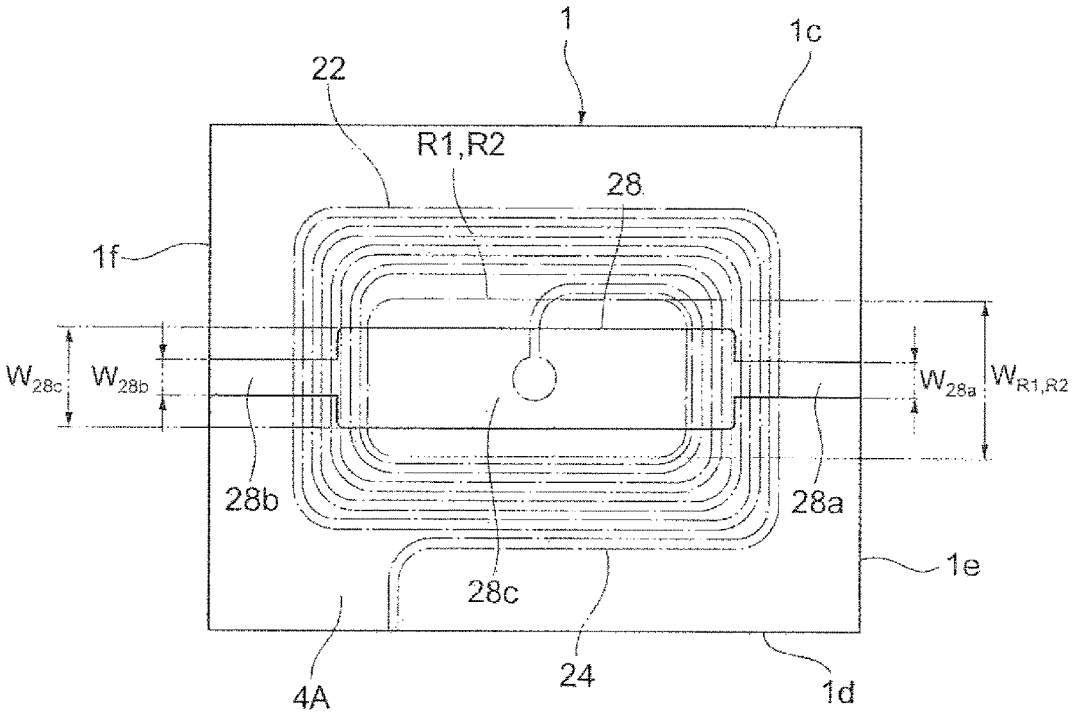
FIG. 9 is a plan view illustrating a second conductor.

The second conductor 28 includes a first conductor portion 28*a*, a second conductor portion 28*b*, and a third conductor portion 28*c*, as illustrated in FIG. 9. The second conductor 28 is of a shape extending in a line. In this embodiment, the second conductor 28 is of a shape extending in a straight line. The first conductor portion 28*a*, the second conductor portion 28*b*, and the third conductor portion 28*c* are integrally formed.

The first conductor portion 28*a* includes one end that is exposed to the third side surface 1*e*. The one end of the first conductor portion 28*a* is connected to the first terminal ground electrode 15. The second conductor portion 28*b* includes one end that is exposed to the fourth side surface 1*f*. The one end of the second conductor portion 28*b* is connected to the second terminal ground electrode 16. The third conductor portion 28*c* connects the first conductor portion 28*a* and the second conductor portion 28*b*. The third conductor portion 28*c* includes one end that is connected to the other end of the first conductor portion 28*a* and the other end that is connected to the other end of the second conductor portion 28*b*.

The second conductor 28 is connected to the first terminal ground electrode 15 and the second terminal ground electrode 16. The first terminal ground electrode 15 and the second terminal ground electrode 16 are electrically connected via the first conductor portion 28*a*, the third conductor portion 28*c*, and the second conductor portion 28*b*.

A width $W_{28c}$ of the third conductor portion 28*c* is larger than a width $W_{28a}$ of the first conductor portion 28*a* and a width $W_{28b}$ of the second conductor portion 28*b*. In this embodiment, the width $W_{28a}$ and the width $W_{28b}$ are equivalent to each other. The width $W_{28a}$ and the width $W_{28b}$ are equivalent to the width $W_{25a}$ and the width $W_{25b}$.

The second conductor 28 overlaps a part of the second coil C2, that is, a part of the fourth coil conductor 24, when viewed from the lamination direction. In this embodiment, each of a region of the other end side of the first conductor portion 28*a*, a region of the other end side of the second conductor portion 28*b*, a region of one end side of the third conductor portion 28*c*, and a region of the other end side of the third conductor portion 28*c* overlaps the fourth coil conductor 24, when viewed from the lamination direction.

A boundary between the first conductor portion 28*a* and the third conductor portion 28*c* and a boundary between the second conductor portion 28*b* and the third conductor portion 28*c* overlap the second coil C2, when viewed from the lamination direction. Specifically, the boundary between the first conductor portion 28*a* and the third conductor portion 28*c* and the boundary between the second conductor portion 28*b* and the third conductor portion 28*c* are positioned in an annular region in which an entire conductor portion of a spiral shape in the fourth coil conductor 24 is positioned, when viewed from the lamination direction.

An inner region R1 of the first coil C1 and an inner region R2 of the second coil C2 include regions not overlapping the first conductor 25 and the second conductor 28, when viewed from the lamination direction. The third conductor portion 25*c* of the first conductor 25 and the third conductor portion 28*c* of the second conductor 28 overlap the individual inner regions R1 and R2, when viewed from the lamination direction. The width $W_{25c}$ of the third conductor portion 25*c* and the width $W_{25c}$ of the third conductor portion 28*c* are smaller than widths $W_{R1}$ and $W_{R2}$ of the individual inner regions R1 and R2. The individual inner regions R1 and R2 include regions not overlapping the first conductor 25 (third conductor portion 25*c*) and the second conductor 28 (third conductor portion 28*c*) at both sides of the third conductor portions 25*c* and 28*c* in a direction in which the first side surface 1*c* and the second side surface 1*d* oppose each other, when viewed from the lamination direction.

The inner region R1 is a region positioned at the inner side of each conductor portion of the spiral shape in the first coil conductor 21 and the second coil conductor 22, when viewed from the lamination direction, as illustrated in FIGS. 6A and 6B. The inner region R2 is a region positioned at the inner side of each conductor portion of the spiral shape in the third coil conductor 23 and the fourth coil conductor 24, when viewed from the lamination direction, as illustrated in FIGS. 7A and 7B.

An overlapping area of the first conductor 25 and the first coil C1 (first coil conductor 21) and an overlapping area of the second conductor 28 and the second coil C2 (fourth coil conductor 24) are equivalent to each other.

A thickness TH1 of each of the first conductor 25 and the second conductor 28 is smaller than a thickness TH2 of each of the first coil conductor 21, the second coil conductor 22, the third coil conductor 23, and the fourth coil conductor 24. The thickness TH2 of each of the first coil conductor 21, the second coil conductor 22, the third coil conductor 23, and the fourth coil conductor 24 is 9 to 11 μm, for example. The thickness TH1 of each of the conductors 25 and 28 is 4 to 6 μm, for example.

Figure 10:
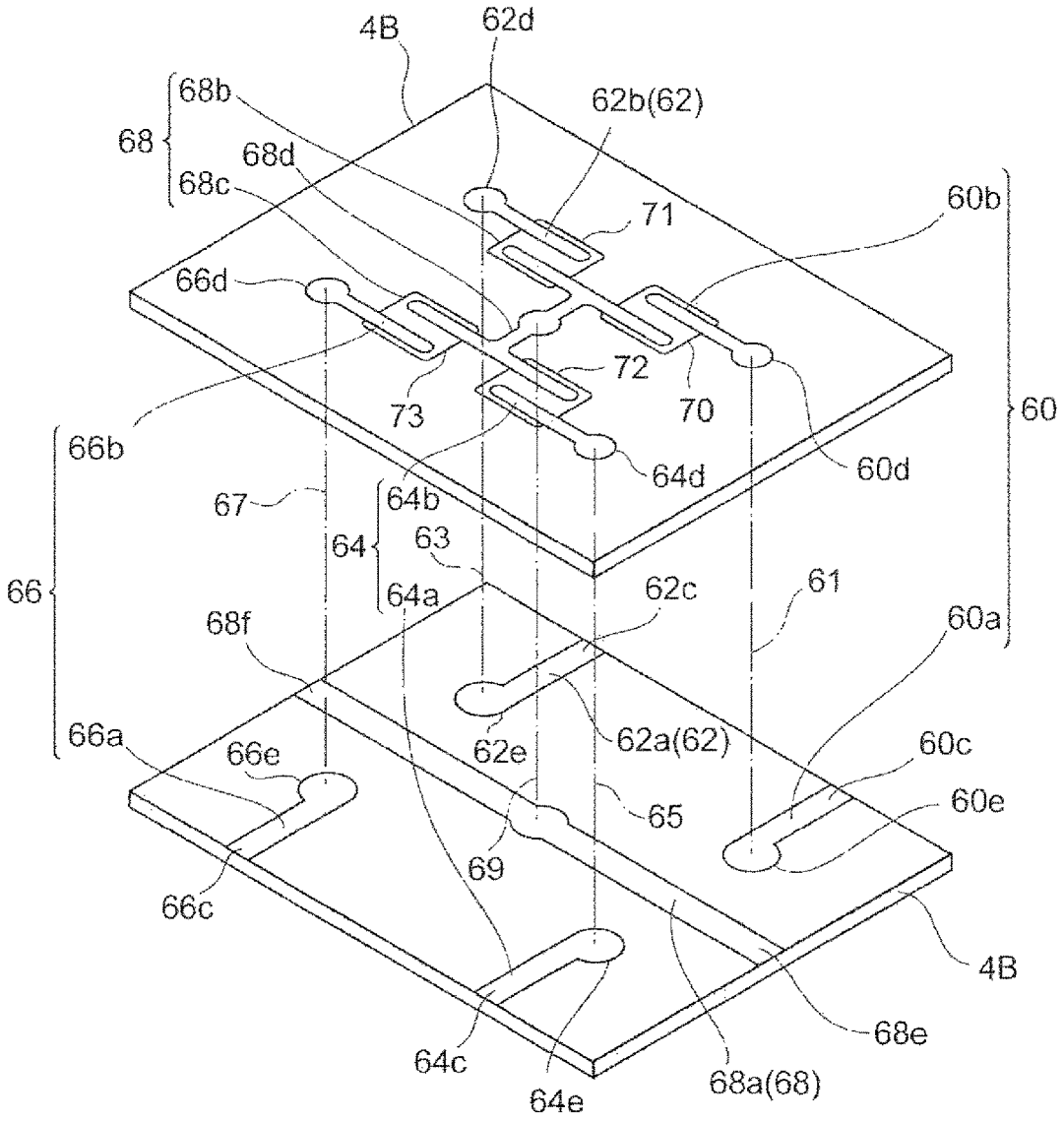
FIG. 10 is an exploded perspective view illustrating a configuration of a portion including the first gap portion, the second gap portion, the third gap portion, and the fourth gap portion.

The multilayer common mode filter CF includes discharge electrodes 60, 62, 64, 66, and 68 and discharge inducing portions 70 to 73, as illustrated in FIGS. 4, 5, and 10. The pair of discharge electrodes 60 and 68 and the discharge inducing portion 70 function as an ESD suppressor having ESD absorption capability. The pair of discharge electrodes 62 and 68 and the discharge inducing portion 71 function as an ESD suppressor having ESD absorption capability. The pair of discharge electrodes 64 and 68 and the discharge inducing portion 72 function as an ESD suppressor having ESD absorption capability. The pair of discharge electrodes 66 and 68 and the discharge inducing portion 73 function as an ESD suppressor having ESD absorption capability. Each ESD suppressor is disposed in the non-magnetic portion 3B.

The discharge electrode 60 is disposed at a position closer to the third side surface 1*e* than the fourth side surface 1*f* in the longitudinal direction of the element body 1 and a position closer to the first side surface 1*c* than the second side surface 1*d* in the width direction of the element body 1. The discharge electrode 60 includes a first connection portion 60*a* and a first opposing portion 60*b*. The first connection portion 60*a* and the first opposing portion 60*b* are disposed on the different non-magnetic layers 4.

The first connection portion 60*a* extends along the width direction of the element body 1. One end 60*c* of the first connection portion 60*a* is exposed to the first side surface 1*c* of the element body 1 and is connected to the first terminal electrode 11. The first opposing portion 60*b* extends along the longitudinal direction of the element body 1. One end 60*d* of the first opposing portion 60*b* is electrically connected to the other end 60*e* of the first connection portion 60*a* via a through-hole conductor 61. The first opposing portion 60*b* is electrically connected to the first terminal electrode 11 via the through-hole conductor 61 and the first connection portion 60*a*.

The discharge electrode 62 is disposed at a position closer to the fourth side surface if than the third side surface 1*e* in the longitudinal direction of the element body 1 and a position closer to the first side surface 1*c* than the second side surface 1*d* in the width direction of the element body 1. The discharge electrode 62 includes a first connection portion 62*a* and a first opposing portion 62*b*. The first connection portion 62*a* is disposed on the non-magnetic layer 4 on which the first connection portion 60*a* is disposed. The first opposing portion 62*b* is disposed on the non-magnetic layer 4 on which the first opposing portion 60*b* is disposed. The first connection portion 62*a* and the first opposing portion 62*b* are disposed on the different non-magnetic layers 4.

The first connection portion 62*a* extends along the width direction of the element body 1. One end 62*c* of the first connection portion 62*a* is exposed to the first side surface 1*c* of the element body 1 and is connected to the third terminal electrode 13. The first opposing portion 62*b* extends along the longitudinal direction of the element body 1. One end 62*d* of the first opposing portion 62*b* is electrically connected to the other end 62*e* of the first connection portion 62*a* via a through-hole conductor 63. The first opposing portion 62*b* is electrically connected to the third terminal electrode 13 via the through-hole conductor 63 and the first connection portion 62*a*.

The discharge electrode 64 is disposed at a position closer to the third side surface 1*e* than the fourth side surface 1*f* in the longitudinal direction of the element body 1 and a position closer to the second side surface 1*d* than the first side surface 1*c* in the width direction of the element body 1. The discharge electrode 64 includes a first connection portion 64*a* and a first opposing portion 64*b*. The first connection portion 64*a* is disposed on the non-magnetic layer 4 on which the first connection portions 60*a* and 62*a* are disposed. The first opposing portion 64*b* is disposed on the non-magnetic layer 4 on which the first opposing portions 60*b* and 62*b* are disposed. The first connection portion 64*a* and the first opposing portion 64*b* are disposed on the different non-magnetic layers 4.

The first connection portion 64*a* extends along the width direction of the element body 1. One end 64*c* of the first connection portion 64*a* is exposed to the second side surface 1*d* of the element body 1 and is connected to the second terminal electrode 12. The first opposing portion 64*b* extends along the longitudinal direction of the element body 1. One end 64*d* of the first opposing portion 64*b* is electrically connected to the other end 64*e* of the first connection portion 64*a* via a through-hole conductor 65. The first opposing portion 64*b* is electrically connected to the second terminal electrode 12 via the through-hole conductor 65 and the first connection portion 64*a*.

The discharge electrode 66 is disposed at a position closer to the fourth side surface 1*f* than the third side surface 1*e* in the longitudinal direction of the element body 1 and a position closer to the second side surface 1*d* than the first side surface 1*c* in the width direction of the element body 1. The discharge electrode 66 includes a first connection portion 66*a* and a first opposing portion 66*b*. The first connection portion 66*a* is disposed on the non-magnetic layer 4 on which the first connection portions 60*a*, 62*a*, and 64*a* are disposed. The first opposing portion 66*b* is disposed on the non-magnetic layer 4 on which the first opposing portions 60*b*, 62*b*, and 64*b* are disposed. The first connection portion 66*a* and the first opposing portion 66*b* are disposed on the different non-magnetic layers 4.

The first connection portion 66*a* extends along the width direction of the element body 1. One end 66*c* of the first connection portion 66*a* is exposed to the second side surface 1*d* of the element body 1 and is connected to the fourth terminal electrode 14. The first opposing portion 66*b* extends along the longitudinal direction of the element body 1. One end 66*d* of the first opposing portion 66*b* is electrically connected to the other end 66*e* of the first connection portion 66*a* via a through-hole conductor 67. The first opposing portion 66*b* is electrically connected to the fourth terminal electrode 14 via the through-hole conductor 67 and the first connection portion 66*a*.

The discharge electrode 68 includes a second connection portion 68*a* and second opposing portions 68*b* and 68*c*. The second connection portion 68*a* is disposed on the non-magnetic layer 4 on which the first connection portions 60*a*, 62*a*, 64*a*, and 66*a* are disposed. The second opposing portions 68*b* and 68*c* are disposed on the non-magnetic layer 4 on which the first opposing portions 60*b*, 62*b*, 64*b*, and 66*b* are disposed. The second connection portion 68*a* and the second opposing portions 68*b* and 68*c* are disposed on the different non-magnetic layers 4.

The second connection portion 68*a* is disposed at an approximately center position in the width direction of the element body 1. The second connection portion 68*a* extends in the longitudinal direction of the element body 1. One end 68*e* of the second connection portion 68*a* is exposed to the third side surface 1*e* of the element body 1 and is connected to the first terminal ground electrode 15. The other end 68*f* of the second connection portion 68*a* is exposed to the fourth side surface 1*f* of the element body 1 and is connected to the second terminal ground electrode 16.

The second opposing portions 68*b* and 68*c* are separated from each other in the width direction of the element body 1, when viewed from the lamination direction. The second opposing portions 68*b* and 68*c* extend in the longitudinal direction of the element body 1. The second opposing portions 68*b* and 68*c* are electrically connected via a connection portion 68*d*. One end of the connection portion 68*d* is connected to approximately a center of the second opposing portion 68*b* in the longitudinal direction of the element body 1. The other end of the connection portion 68*d* is connected to approximately a center of the second opposing portion 68*c* in the longitudinal direction of the element body 1. The second opposing portions 68*b* and 68*c* and the connection portion 68*d* are integrally formed. The connection portion 68*d* extends in the width direction of the element body 1.

The connection portion 68*d* is electrically connected to the second connection portion 68*a* via a through-hole conductor 69. The second opposing portions 68*b* and 68*c* are electrically connected to the first terminal ground electrode 15 and the second terminal ground electrode 16 via the connection portion 68*d*, the through-hole conductor 69, and the second connection portion 68*a*. The second connection portion 68*a* functions as a conductor layer that electrically connects the first terminal ground electrode 15 and the second terminal ground electrode 16.

The second opposing portion 68*b* opposes the first opposing portions 60*b* and 62*b* in the width direction of the element body 1. The second opposing portion 68*b* and the first opposing portions 60*b* and 62*b* are separated from each other in the width direction of the element body 1. The first opposing portions 60*b* and 62*b* and the second opposing portion 68*b* have the thickness. For this reason, side surfaces of the first opposing portions 60*b* and 62*b* and a side surface of the second opposing portion 68*b* oppose each other.

A first gap portion GP1 is formed between the first opposing portion 60*b* and the second opposing portion 68*b* (refer to FIG. 4). A second gap portion GP2 is formed between the first opposing portion 62*b* and the second opposing portion 68*b* (refer to FIG. 5). If a predetermined voltage or more is applied between the first terminal ground electrode 15 and second terminal ground electrode 16 and the first terminal electrode 11, electric discharge is generated by the first gap portion GP1. If a predetermined voltage or more is applied between the third terminal electrode 13 and first terminal ground electrode 15 and the second terminal ground electrode 16, electric discharge is generated by the second gap portion GP2. A width of each of the gap portions GP1 and GP2 is set to a predetermined value, in such a manner that a desired discharge characteristic is obtained.

The second opposing portion 68*c* opposes the first opposing portions 64*b* and 66*b* in the width direction of the element body 1. The second opposing portion 68*c* and the first opposing portions 64*b* and 66*b* are separated from each other in the width direction of the element body 1. The first opposing portions 64*b* and 66*b* and the second opposing portion 68*c* have the thickness. For this reason, side surfaces of the first opposing portions 64*b* and 66*b* and a side surface of the second opposing portion 68*c* oppose each other.

A third gap portion GP3 is formed between the first opposing portion 64*b* and the second opposing portion 68*c* (refer to FIG. 4). A fourth gap portion GP4 is formed between the first opposing portion 66*b* and the second opposing portion 68*c* (refer to FIG. 5). If a predetermined voltage or more is applied between the first terminal ground electrode 15 and second terminal ground electrode 16 and the second terminal electrode 12, electric discharge is generated by the third gap portion GP3. If a predetermined voltage or more is applied between the fourth terminal electrode 14 and first terminal ground electrode 15 and the second terminal ground electrode 16, electric discharge is generated by the fourth gap portion GP4. A width of each of the gap portions GP3 and GP4 is set to a predetermined value, in such a manner that a desired discharge characteristic is obtained.

Each of the discharge electrodes 60, 62, 64, 66, and 68 and each of the through-hole conductors 61, 63, 65, 67, and 69 include a conductive material (for example, Ag, Pd, Au, Pt, Cu, Ni, Al, Mo, or W). Each of the discharge electrodes 60, 62, 64, 66, and 68 and each of the through-hole conductors 61, 63, 65, 67, and 69 are configured as a sintered body of conductive paste including a conductive material (for example, Ag powder, Pd powder, Au powder, Pt powder, Cu powder, Ni powder, Al powder, Mo powder, or W powder). The through-hole conductors 61, 63, 65, 67, and 69 are formed by sintering conductive paste filled into through-holes formed in ceramic green sheets to form the corresponding non-magnetic layers 4.

The discharge inducing portion 70 contacts the first opposing portion 60*b* and the second opposing portion 68*b*, in such a manner that the first opposing portion 60*b* and the second opposing portion 68*b* are connected. The discharge inducing portion 70 has a function of easily generating the electric discharge in the first gap portion GP1. The discharge inducing portion 71 contacts the first opposing portion 62*b* and the second opposing portion 68*b*, in such a manner that the first opposing portion 62*b* and the second opposing portion 68*b* are connected. The discharge inducing portion 71 has a function of easily generating the electric discharge in the second gap portion GP2.

The discharge inducing portion 72 contacts the first opposing portion 64*b* and the second opposing portion 68*c*, in such a manner that the first opposing portion 64*b* and the second opposing portion 68*c* are connected. The discharge inducing portion 72 has a function of easily generating the electric discharge in the third gap portion GP3. The discharge inducing portion 73 contacts the first opposing portion 66*b* and the second opposing portion 68*c*, in such a manner that the first opposing portion 66*b* and the second opposing portion 68*c* are connected. The discharge inducing portion 73 has a function of easily generating the electric discharge in the fourth gap portion GP4.

The discharge inducing portions 70 to 73 include at least one kind of material selected from the group consisting of $Fe_2O_3$, NiO, CuO, ZnO, MgO, $SiO_2$, $TiO_2$, $Mn_2O_3$, SrO, CaO, BaO, $SnO_2$, $K_2O$, $Al_2O_3$, $ZrO_2$, and $B_2O_3$. The discharge inducing portions 70 to 73 may include two kinds or more of materials selected from the group. Metal particles such as Ag, Pd, Au, Pt, an Ag/Pd alloy, an Ag/Cu alloy, an Ag/Au alloy, or an Ag/Pt alloy are contained in the discharge inducing portions 70 to 73. Semiconductor particles such as $RuO_2$ may be contained in the discharge inducing portions 70 to 73. Glass or tin oxide (SnO or $SnO_2$) may be contained in the discharge inducing portions 70 to 73.

The element body 1 has cavity portions 74 to 77 (refer to FIGS. 4 and 5).

Surfaces defining the cavity portion 74 include individual surfaces of the first opposing portion 60*b* and the second opposing portion 68*b* and the discharge inducing portion 70 (portion exposed from the first opposing portion 60*b* and the second opposing portion 68*b*) and surfaces opposing the individual surfaces. The cavity portion 74 contacts the first opposing portion 60*b* and the second opposing portion 68*b* and the discharge inducing portion 70 portion exposed from the first opposing portion 60*b* and the second opposing portion 68*b*). The cavity portion 74 has a function of absorbing thermal expansion of the first opposing portion 60*b*, the second opposing portion 68*b*, the non-magnetic layer 4, and the discharge inducing portion 70 during the electric discharge.

Surfaces defining the cavity portion 75 include individual surfaces of the first opposing portion 62*b* and the second opposing portion 68*b* and the discharge inducing portion 71 (portion exposed from the first opposing portion 62*b* and the second opposing portion 68*b*) and surfaces opposing the individual surfaces. The cavity portion 75 contacts the first opposing portion 62*b* and the second opposing portion 68*b* and the discharge inducing portion 71 (portion exposed from the first opposing portion 62*b* and the second opposing portion 68*b*). The cavity portion 75 has a function of absorbing thermal expansion of the first opposing portion 62*b*, the second opposing portion 68*b*, the non-magnetic layer 4, and the discharge inducing portion 71 during the electric discharge.

Surfaces defining the cavity portion 76 include individual surfaces of the first opposing portion 64*b* and the second opposing portion 68*c* and the discharge inducing portion 72 (portion exposed from the first opposing portion 64*b* and the second opposing portion 68*c*) and surfaces opposing the individual surfaces. The cavity portion 76 contacts the first opposing portion 64*b* and the second opposing portion 68*c* and the discharge inducing portion 72 (portion exposed from the first opposing portion 64*b* and the second opposing portion 68*c*). The cavity portion 76 has a function of absorbing thermal expansion of the first opposing portion 64*b*, the second opposing portion 68*c*, the non-magnetic layer 4, and the discharge inducing portion 72 during the electric discharge.

Surfaces defining the cavity portion 77 include individual surfaces of the first opposing portion 66*b* and the second opposing portion 68*c* and the discharge inducing portion 73 (portion exposed from the first opposing portion 66*b* and the second opposing portion 68*c*) and surfaces opposing the individual surfaces. The cavity portion 77 contacts the first opposing portion 66*b* and the second opposing portion 68*c* and the discharge inducing portion 73 (portion exposed from the first opposing portion 66*b* and the second opposing portion 68*c*). The cavity portion 77 has a function of absorbing thermal expansion of the first opposing portion 66*b*, the second opposing portion 68*c*, the non-magnetic layer 4, and the discharge inducing portion 73 during the electric discharge.

A conductor is not disposed in the non-magnetic portion 3C, different from the non-magnetic portion 3A in which the first coil C1 and the second coil C2 are disposed and the non-magnetic portion 3B in which the ESD suppressor is disposed. The non-magnetic portion 3C is positioned at the side opposite to the side of the non-magnetic portion 3B with the non-magnetic portion 3A therebetween, in a relation of the three non-magnetic portions 3A, 3B, and 3C. The non-magnetic portion 3C alleviates internal stress generated in the element body 1 during firing.

As described above, in this embodiment, the first conductor 25 and the second conductor 28 are connected to the first terminal ground electrode 15 and the second terminal ground electrode 16. The first conductor 25 and the second conductor 28 are connected to the ground via the first terminal ground electrode 15 and the second terminal ground electrode 16.

The first conductor 25 adjacent to the first coil C1 (first coil conductor 21) in the lamination direction (direction in which the pair of magnetic portions 5A and 5B oppose each other) overlaps a part of the first coil C1 (first coil conductor 21) when viewed from the lamination direction. For this reason, a floating capacity is generated between the first conductor 25 and the first coil C1. The second conductor 28 adjacent to the second coil C2 (fourth coil conductor 24) in the lamination direction overlaps a part of the second coil C2 (fourth coil conductor 24) when viewed from the lamination direction. For this reason, a floating capacity is generated between the second conductor 28 and the second coil C2. Therefore, in the multilayer common mode filter CF, an attenuation peak (attenuation pole) in a frequency characteristic of an attenuation amount for a common mode noise is shifted to a high frequency side and a depth thereof is large.

The first conductor 25 and the second conductor 28 are of the shape extending in the line. Therefore, even when magnetic flux generated by the first coil C1 and the second coil C2 passes through the first conductor 25 and the second conductor 28, counter-electromotive force is hard to be generated in the first conductor 25 and the second conductor 28. The individual inner regions R1 and R2 of the first coil C1 and the second coil C2 include regions not overlapping the first conductor 25 and the second conductor 28 when viewed from the lamination direction. For this reason, the magnetic flux generated by the first coil C1 and the second coil C2 is hard to be inhibited by the first conductor 25 and the second conductor 28. As a result, in the multilayer common mode filter CF, common mode impedance is suppressed from decreasing.

In this embodiment, the first conductor 25 and the second conductor 28 are of the shape extending in the straight line. Therefore, parasitic inductance of the first conductor 25 and the second conductor 28 is small in the multilayer common mode filter CF, as compared with a multilayer common mode filter in which the first conductor 25 and the second conductor 28 have a shape (for example, a meanderingly extending shape or a crank shape) other than the shape extending in the straight line. As a result, the depth of the attenuation peak is larger.

In this embodiment, the individual widths $W_{25a}$, $W_{25b}$, $W_{25c}$, $W_{28a}$, $W_{28b}$, and $W_{28c}$ of the first conductor 25 and the second conductor 28 are smaller than the widths $W_{R1}$ and $W_{R2}$ of the individual inner regions R1 and R2 of the first coil C1 and the second coil C2. As a result, even in the case in which the first conductor 25 and the second conductor 28 overlap the individual inner regions R1 and R2 of the first coil C1 and the second coil C2 when viewed from the lamination direction, the individual inner regions R1 and R2 of the first coil C1 and the second coil C2 surely include regions not overlapping the first conductor 25 and the second conductor 28 when viewed from the lamination direction.

In this embodiment, the first conductor 25 includes the first conductor portion 25*a*, the second conductor portion 25*b*, and the third conductor portion 25*c* and the second conductor 28 includes the first conductor portion 28*a*, the second conductor portion 28*b*, and the third conductor portion 28*c*. The widths $W_{25c}$ and $W_{28c}$ of the third conductor portions 25*c* and 28*c* are larger than the widths $W_{25a}$ and $W_{28a}$ of the first conductor portions 25*a* and 28*a* and the widths $W_{25b}$ and $W_{28b}$ of the second conductor portions 25*b* and 28*b*. The boundary between the first conductor portion 25*a* and the third conductor portion 25*c* and the boundary between the second conductor portion 25*b* and the third conductor portion 25*c* overlap the first coil C1 and the second coil C2 when viewed from the lamination direction. Also, the boundary between the first conductor portion 28*a* and the third conductor portion 28*c* and the boundaries of the second conductor portions 25*b* and 28*b* and the third conductor portions 25*c* and 28*c* overlap the first coil C1 and the second coil C2 when viewed from the lamination direction.

The one end of the first conductor portion 25*a* and the one end of the first conductor portion 28*a* are exposed to the surface (first side surface 1*c*) of the non-magnetic portion 3A and is connected to the first terminal ground electrode 15. For this reason, the one end of the first conductor portion 25*a* and the one end of the first conductor portion 28*a* need to be covered with the first terminal ground electrode 15, and the widths $W_{25a}$ and $W_{25a}$ need to be set smaller than the width of the first terminal ground electrode 15.

The one end of the second conductor portion 25*b* and the one end of the second conductor portion 28*b* are exposed to the surface (second side surface 1*d*) of the non-magnetic portion 3A and is connected to the second terminal ground electrode 16. For this reason, the one end of the second conductor portion 25*b* and the one end of the second conductor portion 28*b* need to be covered with the second terminal ground electrode 16 and the widths $W_{25b}$ and $W_{28b}$ need to be set smaller than the width of the second terminal ground electrode 16.

If the width of the first conductor 25 increases, residual inductance in the floating capacity generated between the first conductor 25 and the first coil C1 decreases. If the width of the second conductor 28 increases, residual inductance in the floating capacity generated between the second conductor 28 and the second coil C2 decreases. If the residual inductance decreases, the depth of the attenuation peak increases.

In the case in which the boundary between the first conductor portion 25*a* and the third conductor portion 25*c* and the boundary between the second conductor portion 25*b* and the third conductor portion 25*c* overlap the first coil C1 when viewed from the lamination direction, the third conductor portion 25*c* wider than the first conductor portion 25*a* and the second conductor portion 25*b* surely overlaps the first coil C1 when viewed from the lamination direction. In the case in which the boundary between the first conductor portion 28*a* and the third conductor portion 28*c* and the boundary between the second conductor portion 28*b* and the third conductor portion 28*c* overlap the second coil C2 when viewed from the lamination direction, the third conductor portion 28*c* wider than the first conductor portion 28*a* and the second conductor portion 28*b* surely overlaps the second coil C2 when viewed from the lamination direction.

In the case in which the widths $W_{25c}$ and $W_{28c}$ are larger than the widths $W_{25a}$, $W_{25b}$, $W_{28a}$, and $W_{28b}$, that is, the widths $W_{25a}$, $W_{25b}$, $W_{28a}$, and $W_{28b}$ are smaller than the widths $W_{25c}$ and $W_{28c}$, connectivity of the first conductor portions 25*a* and 28*a* and the first terminal ground electrode 15 and connectivity of the second conductor portions 25*b* and 28*b* and the second terminal ground electrode 16 are secured, and the depth of the attenuation peak is large.

In the case in which the boundary between the first conductor portion 25*a* and the third conductor portion 25*c* and the boundary between the second conductor portion 25*b* and the third conductor portion 25*c* overlap the first coil C1 when viewed from the lamination direction, even when a position deviation occurs in the first coil C1 and the first conductor 25, the floating capacity generated between the first conductor 25 and the first coil C1 is hard to be varied. When the position deviation is a position deviation in the direction in which the third side surface 1*e* and the fourth side surface 1*f* oppose each other, the floating capacity generated between the first conductor 25 and the first coil C1 is rarely varied.

In the case in which the boundary between the first conductor portion 28*a* and the third conductor portion 28*c* and the boundary between the second conductor portion 28*b* and the third conductor portion 28*c* overlap the second coil C2 when viewed from the lamination direction, even when a position deviation occurs in the second coil C2 and the second conductor 28, the floating capacity generated between the second conductor 28 and the second coil C2 is hard to be varied. When the position deviation is a position deviation in the direction in which the third side surface 1*e* and the fourth side surface 1*f* oppose each other, the floating capacity generated between the second conductor 28 and the second coil C2 is rarely varied.

From the above configuration, the characteristic of the multilayer common mode filter CF is suppressed from being varied.

The overlapping area of the first conductor 25 and the first coil C1 (first coil conductor 21) and the overlapping area of the second conductor 28 and the second coil C2 (fourth coil conductor 24) are equivalent to each other. Therefore, in the case in which a signal is input from one end of the first coil C1, that is, the first terminal electrode 11 and in the case in which a signal is input from the other end of the first coil C1, that is, the second terminal electrode 12, a change in the characteristic impedance is small. Likewise, in the case in which a signal is input from one end of the second coil C2, that is, the fourth terminal electrode 14 and in the case in which a signal is input from the other end of the second coil C2, that is, the third terminal electrode 13, a change in the characteristic impedance is small. As a result, directionality when the multilayer common mode filter CF is mounted can be eliminated.

In this embodiment, the first coil C1 includes the first coil conductor 21 and second coil conductor 22 of the spiral shape, and the first coil conductor 21 and the second coil conductor 22 are electrically connected to each other. The second coil C2 includes the third coil conductor 23 and fourth coil conductor 24 of the spiral shape, and the third coil conductor 23 and the fourth coil conductor 24 are electrically connected to each other. The first coil conductor 21 and the third coil conductor 23 are adjacent to each other in the lamination direction, the second coil conductor 22 and the fourth coil conductor 24 are adjacent to each other in the lamination direction, and the third coil conductor 23 is positioned between the first coil conductor 21 and the second coil conductor 22 in the lamination direction. Therefore, in the multilayer common mode filter CF, magnetic coupling of the first coil C1 and the second coil C2 is strong.

In this embodiment, the first conductor 25 and the second conductor 28 are not positioned between the first coil C1 and the second coil C2 in the lamination direction. For this reason, the first conductor 25 and the second conductor 28 do not inhibit the magnetic coupling of the first coil C1 and the second coil C2.

The first conductor 25 and the second conductor 28 electrically connect the first terminal ground electrode 15 and the second terminal ground electrode 16. In this case, the first terminal ground electrode 15 and the second terminal ground electrode 16 are electrically connected via the first conductor 25 and the second conductor 28. For this reason, when the first terminal ground electrode 15 and the second terminal ground electrode 16 are formed, electroplating can be performed.

In the multilayer common mode filter CF, the discharge electrodes 60, 62, 64, and 66 (first opposing portions 60*b*, 62*b*, 64*b*, and 66*b*) and the discharge electrode 68 (second opposing portion 68*b*) are separated from each other. The discharge electrode 68 is connected to the first terminal ground electrode 15 and the second terminal ground electrode 16. That is, the discharge electrode 68 is connected to the ground via the first terminal ground electrode 15 and the second terminal ground electrode 16. Therefore, the multilayer common mode filter CF has the ESD absorption function. In the multilayer common mode filter CF, because the ground to release static electricity and the ground to which the first conductor 25 and the second conductor 28 are connected are commonalized, a configuration is suppressed from becoming complicated.

In the multilayer common mode filter CF, because the thickness TH1 of each of the first conductor 25 and the second conductor 28 is smaller than the thickness TH2 of each of the first coil conductor 21, the second coil conductor 22, the third coil conductor 23, and the fourth coil conductor 24, an interval between the pair of magnetic portions 5A and 5B in the lamination direction is small as compared with a multilayer common mode filter in which the thickness TH1 is equal to or larger than the thickness TH2. For this reason, in the multilayer common mode filter CF, the inductance is suppressed from decreasing.

A test for comparing frequency characteristics of common mode impedances and frequency characteristics of attenuation amounts for common mode noises in the multilayer common mode filter CF according to this embodiment and multilayer common mode filters according to comparative examples has been performed. A test result obtained by comparing the frequency characteristics of the common mode impedances is illustrated in FIG. 11 and a test result obtained by comparing the frequency characteristics of the attenuation amounts is illustrated in FIG. 12.

A multilayer common mode filter according to a comparative example 1 is different from the multilayer common mode filter CF in that the first conductor 25 and the second conductor 28 are not included. A multilayer common mode filter according to a comparative example 2 is different from the multilayer common mode filter CF in that the first conductor 25 and the second conductor 28 have an annular shape, as disclosed in FIG. 1 of Japanese Unexamined Patent Publication No. 2012-109326. A multilayer common mode filter according to a comparative example 3 is different from the multilayer common mode filter CF in that the first conductor 25 and the second conductor 28 have a solid shape, as disclosed in FIG. 6 of Japanese Unexamined Patent Publication No. 2012-109326. The multilayer common mode filters according to the comparative examples 1 to 3 and the multilayer common mode filter CF are the same in the configuration other than the difference described above. The first conductor 25 and the second conductor 28 of the solid shape mean that the first conductor 25 and the second conductor 28 are formed to cover the individual inner regions R1 and R2 of the first coil C1 and the second coil C2 as well as the first coil C1 and the second coil C2.

Figure 11:
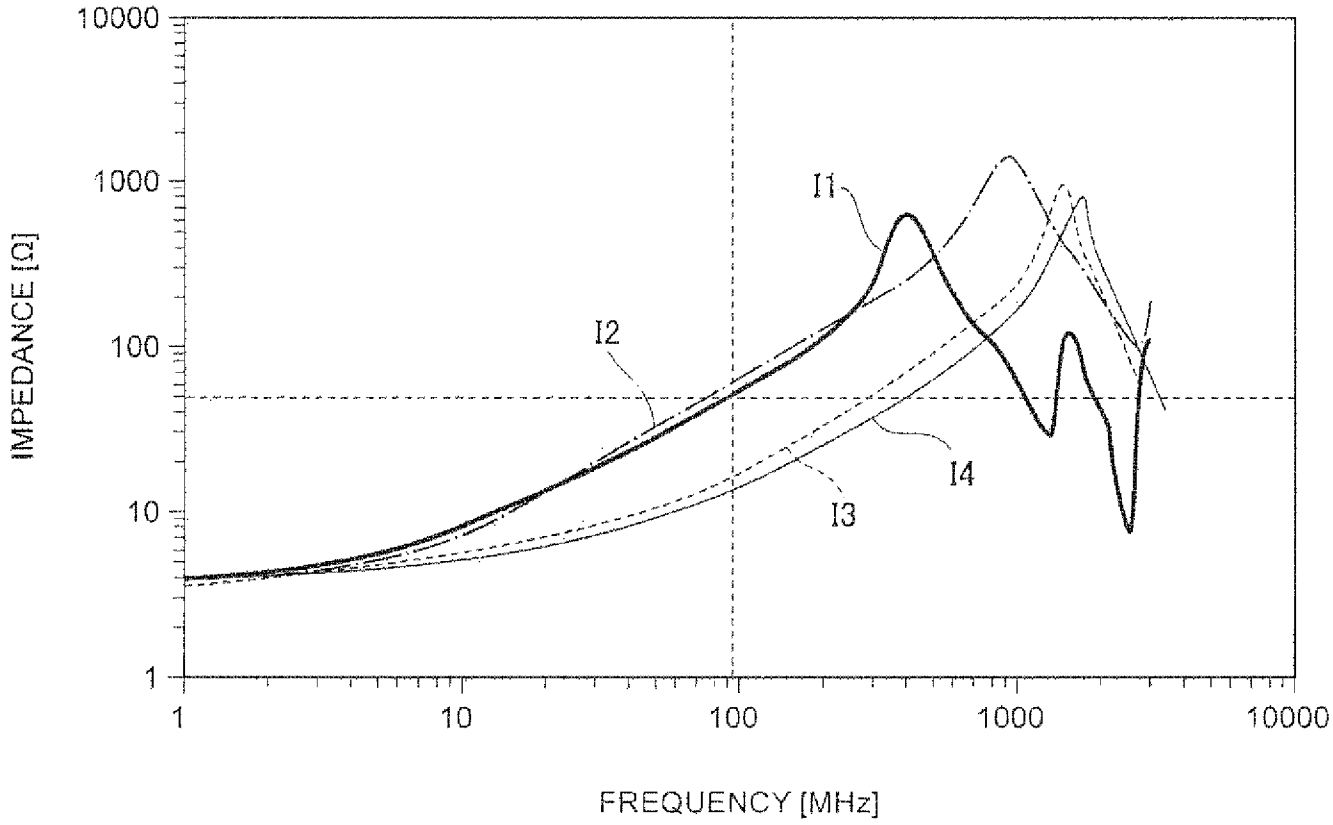
FIG. 11 is a chart illustrating a frequency characteristic of common mode impedance.

As seen from the test result illustrated in FIG. 11, the decrease in the common mode impedance is very small in the multilayer common mode filter CF, as compared with the multilayer common mode filters according to the comparative examples 2 and 3. That is, in the multilayer common mode filters according to the comparative examples 2 and 3, the common mode impedance greatly decreases due to an influence of the counter-electromotive force (eddy current) generated in the first and second conductor layers. In FIG. 11, a characteristic 11 shows a frequency characteristic of the common mode impedance of the multilayer common mode filter CF. Characteristics 12 to 14 show frequency characteristics of the common mode impedances according to the comparative examples 1 to 3, respectively.

Figure 12:
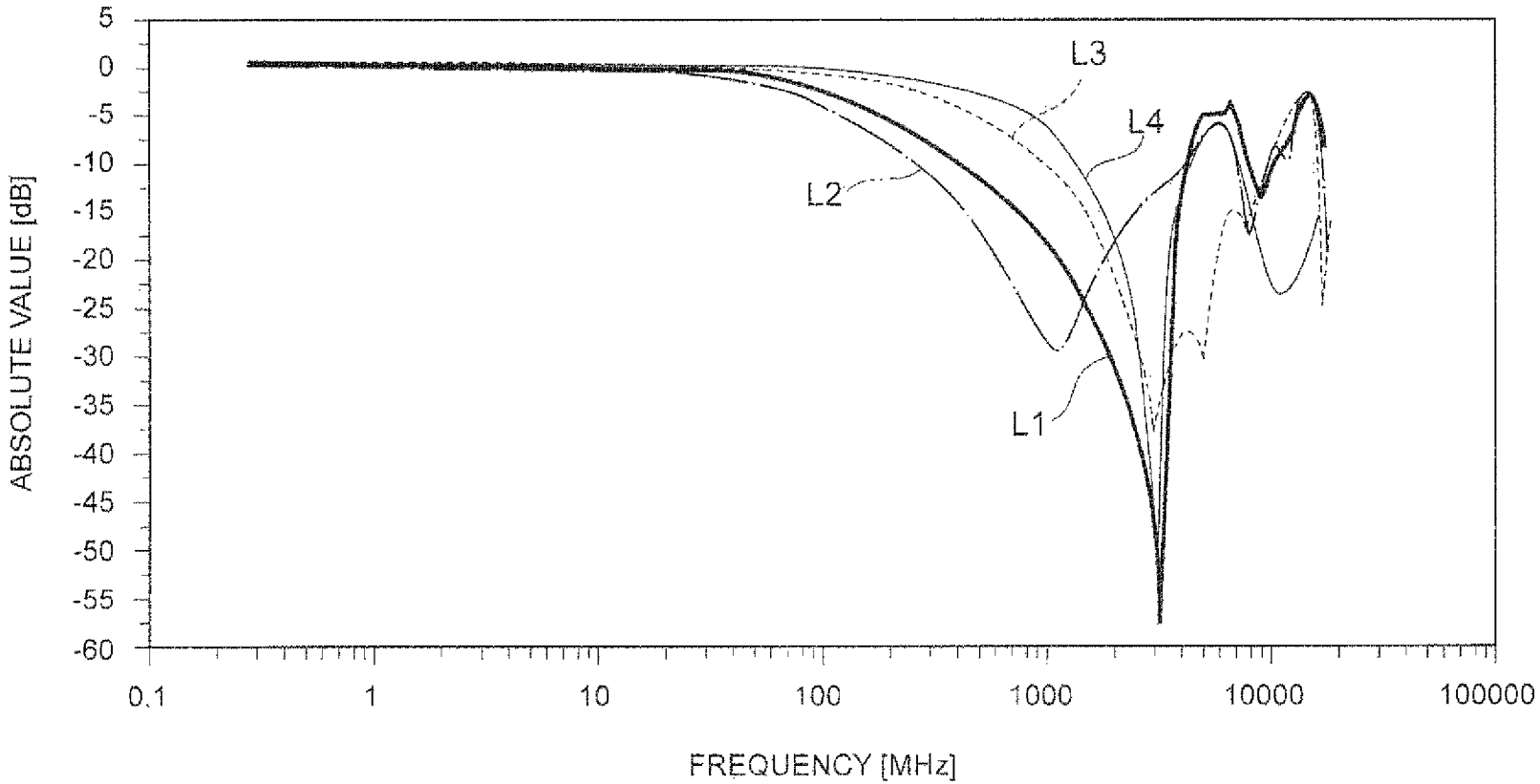
FIG. 12 is a chart illustrating a frequency characteristic of an attenuation amount for common mode noise.

As seen from the test result illustrated in FIG. 12, in the multilayer common mode filter CF, a depth of an attenuation peak in a frequency characteristic of an attenuation amount for the common mode noise is large and a position of the attenuation peak is shifted to a high frequency side, as compared with the multilayer common mode filter according to the comparative example 1. The multilayer common mode filters according to the comparative examples 2 and 3 have steep attenuation characteristics as compared with the multilayer common mode filter CF. That is, in the multilayer common mode filter CF, a frequency band in which a desired attenuation characteristic is obtained is wide as compared with the multilayer common mode filters according to the comparative examples 2 and 3. In FIG. 12, a characteristic L1 shows the attenuation characteristic of the multilayer common mode filter CF. Characteristics L2 to L4 show the attenuation characteristics according to the comparative examples 1 to 3, respectively.

The embodiment of the present invention has been described. However, the present invention is not limited to the embodiment described above and various changes can be made without departing from the gist thereof.

Figure 13:
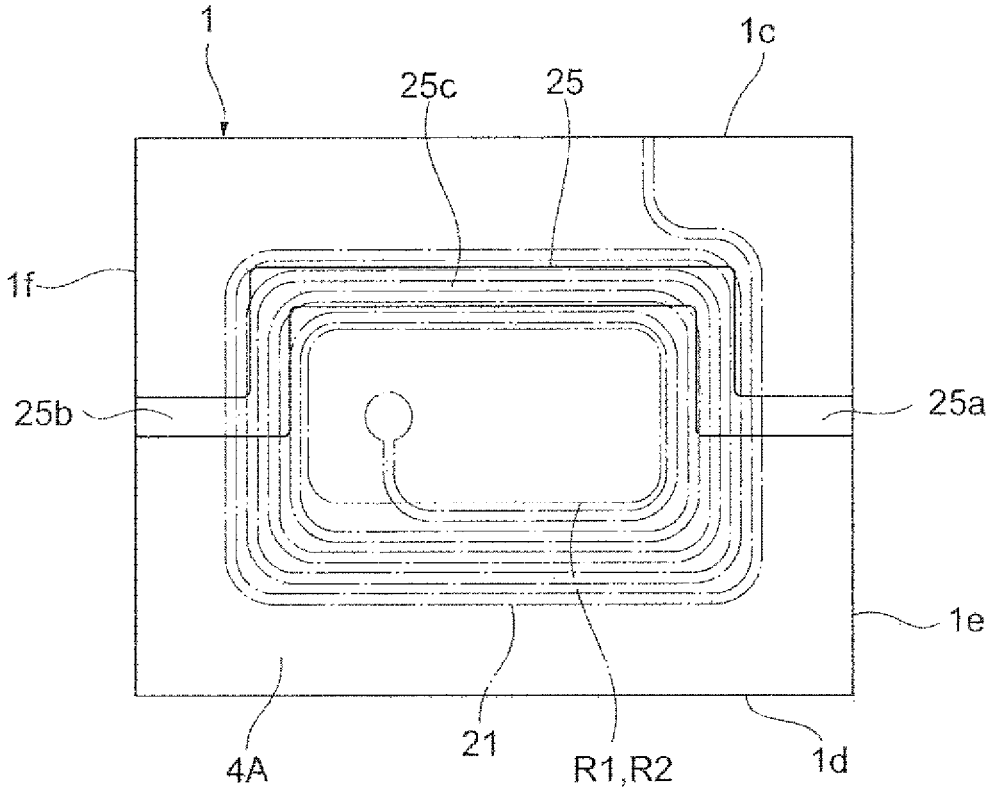
FIG. 13 is a diagram illustrating a modification example of the first conductor.
Figure 14:
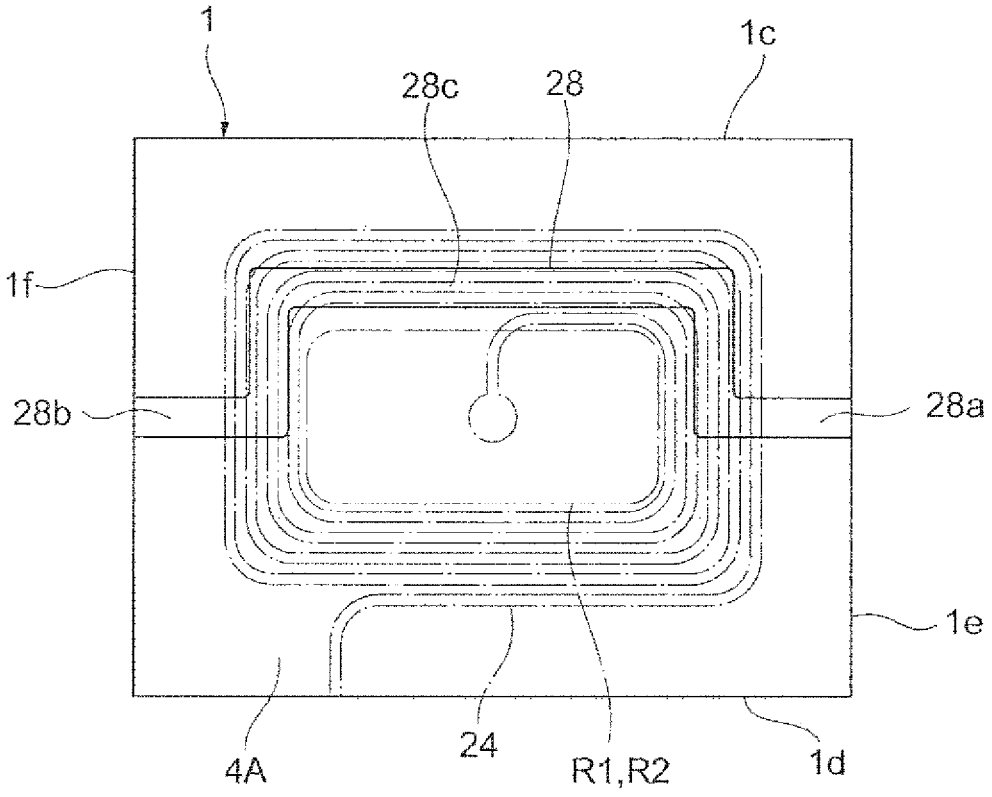
FIG. 14 is a diagram illustrating a modification example of the second conductor.

The shapes of the first conductor 25 and the second conductor 28 are not limited to the shapes illustrated in FIGS. 8 and 9. The first conductor 25 and the second conductor 28 may be bent along the shapes of the first coil C1 and the second coil C2, in such a manner that the first conductor 25 and the second conductor 28 do not overlap the individual inner regions R1 and R2 of the first coil C1 and the second coil C2 when viewed from the lamination direction, as illustrated in FIGS. 13 and 14. In this case, the first conductor 25 and the second conductor 28 are hard to shield the magnetic flux generated by the first coil C1 and the second coil C2. For this reason, the inductance of the multilayer common mode filter CF is further suppressed from decreasing.

The widths $W_{25c}$ and $W_{28c}$ may be equivalent to the widths $W_{25a}$, $W_{28a}$, $W_{25b}$, and $W_{28b}$, as illustrated in FIGS. 13 and 14.

The individual inner regions R1 and R2 include the regions not overlapping the first conductor 25 and the second conductor 28, at both sides of the individual third conductor portions 25*c* and 28*c* in the direction in which the first side surface 1*c* and the second side surface 1*d* oppose each other, when viewed from the lamination direction. However, the present invention is not limited thereto. The individual inner regions R1 and R2 may include the regions not overlapping the first conductor 25 and the second conductor 28, at only one side of the individual third conductor portions 25*c* and 28*c* in the direction in which the first side surface 1*c* and the second side surface 1*d* oppose each other, when viewed from the lamination direction.

In this embodiment, the first coil C1 includes the first coil conductor 21 and second coil conductor 22 of the spiral shape, and the first coil conductor 21 and the second coil conductor 22 are electrically connected to each other. The second coil C2 includes the third coil conductor 23 and the fourth coil conductor 24 of the spiral shape, and the third coil conductor 23 and the fourth coil conductor 24 are electrically connected to each other.

The first coil conductor 21 and the second coil conductor 22 may be adjacent to each other in the lamination direction, the third coil conductor 23 and the fourth coil conductor 24 may be adjacent to each other in the lamination direction, and the second coil conductor 22 and the third coil conductor 23 may be adjacent to each other in the lamination direction. The first coil C1 may be configured by one coil conductor of a spiral shape and the second coil C2 may also be configured by one coil conductor of a spiral shape.

The multilayer common mode filter CF may not include the discharge electrodes 60, 62, 64, 66, and 68 and the discharge inducing portions 70 to 73. That is, the multilayer common mode filter CF may not have the ESD absorption capability.

What is claimed is:

1. A multilayer common mode filter comprising:

an element body that has a non-magnetic portion including a non-magnetic material and a pair of magnetic portions including a magnetic material and opposing each other with the non-magnetic portion therebetween;

a first terminal electrode, a second terminal electrode, a third terminal electrode, a fourth terminal electrode, a first terminal ground electrode, and a second terminal ground electrode that are disposed on the element body;

a first coil that is disposed in the non-magnetic portion and is electrically connected to the first terminal electrode and the third terminal electrode;

a second coil that is disposed in the non-magnetic portion, electrically connected to the second terminal electrode and the fourth terminal electrode, and opposing the first coil in a first direction in which the pair of magnetic portions oppose each other; and first and second conductors that are disposed in the non-magnetic portion, electrically connected to the first terminal ground electrode and the second terminal ground electrode, and are of a shape extending in a line, wherein the first and second coils are positioned between the first conductor and the second conductor in the first direction, the first conductor is adjacent to the first coil in the first direction and overlaps a part of the first coil when viewed from the first direction, the second conductor is adjacent to the second coil in the first direction and overlaps a part of the second coil when viewed from the first direction, and an inner region delimited by an innermost loop of each of the first and second coils includes regions not overlapping the first and second conductors when viewed from the first direction.

2. The multilayer common mode filter according to claim 1, wherein the first and second conductors are of a shape extending in a straight line.

3. The multilayer common mode filter according to claim 1, wherein widths of the first and second conductors are smaller than a width of the inner region of each of the first and second coils.

4. The multilayer common mode filter according to claim 1, wherein each of the first and second conductors includes a first conductor portion connected to the first terminal ground electrode, a second conductor portion connected to the second terminal ground electrode, and a third conductor portion connecting the first conductor portion and the second conductor portion, a width of the third conductor portion is larger than widths of the first and second conductor portions, and a boundary between the first conductor portion and the third conductor portion and a boundary between the second conductor portion and the third conductor portion overlap the first and second coils when viewed from the first direction.

5. The multilayer common mode filter according to claim 1, wherein the first coil includes first and second coil conductors of a spiral shape electrically connected to each other, the second coil includes third and fourth coil conductors of a spiral shape electrically connected to each other, the first coil conductor and the third coil conductor are adjacent to each other in the first direction, the second coil conductor and the fourth coil conductor are adjacent to each other in the first direction, and the third coil conductor is positioned between the first coil conductor and the second coil conductor in the first direction.

6. The multilayer common mode filter according to claim 1, further comprising:

first and second discharge electrodes that are disposed in the element body and are separated from each other, wherein any one of the first and second discharge electrodes is electrically connected to the first terminal ground electrode and the second terminal ground electrode.

* * * * *